US006918375B2

(12) United States Patent
Serizawa et al.

(10) Patent No.: US 6,918,375 B2
(45) Date of Patent: Jul. 19, 2005

(54) METHOD OF CONTROLLING PULSATION RESONANCE POINT GENERATING AREA IN OPPOSED ENGINE OR IN-LINE ENGINE

(75) Inventors: Yoshiyuki Serizawa, Susonoshi (JP); Hikari Tsuchiya, Gotenba (JP); Tetsuo Ogata, Sunto-gun (JP); Kazuteru Mizuno, Numazu (JP); Masayoshi Usui, Numazu (JP); Kazunori Takikawa, Numazu (JP)

(73) Assignee: Usui Kokusai Sangyo Kaisha, Ltd., Shizuoka-ken (JP)

( * ) Notice: Subject to any disclaimer, the term of this patent is extended or adjusted under 35 U.S.C. 154(b) by 0 days.

(21) Appl. No.: 10/433,510

(22) PCT Filed: Aug. 13, 2002

(86) PCT No.: PCT/JP02/08249

§ 371 (c)(1),
(2), (4) Date: Jul. 30, 2003

(87) PCT Pub. No.: WO03/016706

PCT Pub. Date: Feb. 27, 2003

(65) Prior Publication Data

US 2004/0144368 A1 Jul. 29, 2004

(30) Foreign Application Priority Data

Aug. 15, 2001 (JP) ..... 2001-246755

(51) Int. Cl.[7] ..... F02M 37/04
(52) U.S. Cl. ..... 123/447; 123/456
(58) Field of Search ..... 123/447, 456, 123/468, 469, 467

(56) References Cited

U.S. PATENT DOCUMENTS

| | | | | |
|---|---|---|---|---|
| 5,592,968 A | * | 1/1997 | Nakashima et al. | 137/561 A |
| 5,954,031 A | | 9/1999 | Ogiso et al. | |
| 6,401,691 B1 | * | 6/2002 | Kawano et al. | 123/456 |

FOREIGN PATENT DOCUMENTS

| | | |
|---|---|---|
| EP | 0995902 | 4/2000 |
| JP | 63-132872 | 8/1988 |
| JP | 9-151830 | 6/1997 |
| JP | 11-2164 | 1/1999 |
| JP | 2002-295337 | 10/2002 |

* cited by examiner

*Primary Examiner*—Mahmoud Gimie
(74) *Attorney, Agent, or Firm*—Jordan and Hamburg LLP

(57) ABSTRACT

In a fuel supplying mechanism in which fuel delivery pipes of a non-return type are disposed, the generation region of pulsation resonance is arbitrarily controlled, thereby eliminating various disadvantages otherwise occurring where the pulsation resonance point exists in a favorable rotation region for normal use of the engine. A pair of the fuel delivery pipes 1, 2 of a non-return type is disposed for each bank of a horizontal opposed type or V-type engine and coupled with a connection pipe 4. A characteristic period time of a pulsation wave induced by the pulsation wave generated during fuel injection of the injection nozzles 3 via a connection pipe 4 coupling between one to the other of the fuel delivery pipes 1, 2 is controlled to render the characteristic period time longer to shift the pulsation resonance point out of a low rotation region of the engine as well as to render the characteristic period time shorter to shift the pulsation resonance point out of a high rotation region of the engine.

12 Claims, 28 Drawing Sheets

METHOD OF CONTROLLING PULSATION RESONANCE POINT GENERATING AREA IN OPPOSED ENGINE OR IN-LINE ENGINE

TECHNICAL FIELD

This invention relates to a method controlling a pulsation resonance point generating region in opposed type engine or in-line type engine for transiting out of a desirable rotational rate zone of the normal use of the engine a generating point of pulsation resonance generated due to pulsation wave in the opposed type engine or in-line type engine such as a V-type engine, a horizontal opposed type engine, and the like.

BACKGROUND ART

Fuel delivery pipes have conventionally been known in which fuel such as gasoline is supplied to plural cylinders of the engine upon providing plural injection nozzles. The fuel delivery pipe injects the fuel introduced from a fuel tank out of the plural injection nozzles to the inside of a plurality of intake pipes or cylinders of the engine, mixes the fuel wit the air, and generates the engine output by burning the mixture gas.

The fuel delivery pipe, as described above, is for injecting the fuel supplied from the fuel tank via a supplying pipe out of the injection nozzle into the intake pipe or cylinder of the engine. A return type fuel delivery pipe exists in which having a circuit returning excessive fuel to the fuel tank with a pressure adjusting valve in a case where the supplied fuel is excessively supplied to the fuel delivery pipe. Moreover, a non-return type fuel delivery pipe, as different from the return type fuel delivery pipe, also exists in which having no circuit for returning the supplied fuel to the fuel tank.

The types for returning the fuel excessively supplied at the fuel delivery pipe to the fuel tank are advantageous in suppressing pulsation waves accompanying with fuel injections because the fuel amount in the fuel delivery pipe can be kept constant. However, the fuel supplied to the fuel delivery pipe disposed adjacently to the engine cylinder heated at a high temperature increases the temperature of the fuel, and the gasoline temperature in the fuel tank may be increased by returning the excessive fuel of the high temperature to the fuel tank. With this increased temperature, the gasoline may be gassed and unfavorably affect the environments adversely, so that the non-return type fuel delivery pipes have been proposed in which the excessive fuel is not returned to the fuel tank.

The non-return type fuel delivery pipe tends to generate large pulsation waves due to large pressure fractures, and the pulsation waves are generated much more than that in the return type fuel delivery pipe, because the non-return type fuel delivery pipe has no pipe for returning an excessive fuel to the fuel tank where the injection nozzles make injections to the intake pipes or cylinders.

This invention uses a fuel delivery pipe of a non-return type which otherwise tends to generate pulsation waves. In prior art, an interior of the fuel delivery pipe is locally, abruptly subject to a reduced pressure due to the fuel injection out of the injection nozzles into the intake pipes or cylinders of the engine, thereby generating pulsation waves (coarse and dense waves). This pulsation waves, after propagated at propagation rates of the respective pulsation waves in the fuel delivery pipe and the respective structural parts which constituting portions from connection pipes connecting to the fuel delivery pipe to the side of the fuel tank and through which the fuel is in communication, are returned reversely from the pressure adjusting valve in the fuel tank and propagated up to the fuel delivery pipe via the connection pipes. The fuel delivery pipe is formed with the plural injection nozzles, and the plural injection nozzles inject the fuel sequentially, thereby generating the pulsation waves.

The pulsation wave propagates at pulsation wave propagation rate corresponding to the respective structural parts through the system as doing reflections and transmissions according to changes in, e.g., the pulsation wave propagation rate and flowing speed at the boundaries among the structural parts through which the fuel communicates. The fuel delivery pipe ordinarily has a significantly larger flowing route cross section in comparison with the connection pipe or with the supplying pipe and has a large reflectance at a boundary plane at which the pulsation wave transmits from the fuel delivery pipe to the connection pipe and the supplying pipe. In a case where the fuel delivery pipe itself has a mechanism absorbing the pulsation wave with elastic transformation thereof, the propagation rate of the pulsation wave in the fuel delivery pipe becomes low due to significant differences in the elasticity thereof. The elastic transformation due to the pulsation wave can be neglected at the structural parts other than the fuel delivery pipe, and the propagation rate of the pulsation wave becomes an eigenvalue of the medium, or namely the fuel. Consequently, the reflectance at this boundary becomes larger. With this large reflectance, the pressure fluctuation in the fuel delivery pipe is absorbed very gently by the pressure adjusting valve in the fuel tank, and has a period characteristic to the system. The resonance phenomenon occurs when this period coincides to the injection period of the respective injection nozzles.

In a V-type engine, where the fuel delivery pipes are mounted with a pair thereof at each bank, the pulsation wave gently absorbed at the pressure adjusting valve in the fuel tank is made large at a component reciprocating between the fuel delivery pipe pair, and the pulsation wave has a characteristic period gentle as a whole since the reflectance at the boundary plane between the fuel delivery pipe and the connection pipe is large. Substantially in the same manner as above, the resonance phenomenon occurs when this period coincides to the injection period of the respective injection nozzles.

If the pulsation resonance point is generated out of the rotation speed region for the normal use of the engine, there would be no problem, but if the point occurs in the rotation speed region for the normal use of the engine, various disadvantages may be produced. It is to be noted that the rotation region of the engine in this specification means a desirable rotation speed region for the normal use of the engine.

That is, if the pulsation resonance point enters in the rotation region of the engine, the pressure in the fuel delivery pipe is abruptly reduced by the pulsation resonance, thereby generating a phenomenon that the fuel to be injected in the intake pipes or cylinders of the engine decreases. This makes the mixing rate of the fuel gas and the air different from the designed value, so that the exhaustion gas may be adversely affected, or that the designed power may not be pulled out. The pulsation resonance induces mechanical vibrations at the supplying pipe coupled to the side of the fuel tank, and is propagated as noises in the passenger room via clips that engage the supplying pipe to the bottom of the floor, so that the noises give the driver and the passengers uncomfortable feelings.

As conventional methods for reducing the various defects as described above caused by such a pulsation resonance and for suppressing problems caused by occurrences of the pulsation resonance, a pulsation dumper having inside a rubber diaphragm is arranged to the non-return type fuel delivery pipe to reduce the generated pulsation wave energy by absorption of the pulsation dumper, or the supplying pipe disposed below the floor extending from the fuel delivery pipe to the side of the fuel tank is secured with rubber made clips for absorbing vibrations or foamed resin made clips to reduce vibrations generated at the fuel delivery pipe or the supplying pipe extending up to the fuel pipe by absorption. These methods are relatively effective and have an effect to reduce the problems due to generation of the pulsation resonance.

Use of the pulsation dumper or clips for absorbing vibrations, however, though having an effect to reduce the problems due to occurrences of the pulsation resonance, cannot eliminate surely the problems. The pulsation dumper and the clip for absorbing vibrations are expensive, increase the number of the parts and the costs, and also raise new problems to ensure the installation space. Therefore, a fuel delivery pipe has been proposed in having a pulsation absorption function capable of absorbing the pulsation wave for the purpose of reducing the pulsation wave without using such a pulsation dumper or clips for absorbing vibrations and of transiting the generation of the pulsation resonance out of the low rotation region.

As the fuel delivery pipes having such an absorbing function of pulsation waves, known are the inventions in JP-A-2000-329030, JP-A-2000-320422, JP-A-2000-329031, JP-A-H11-37380, JP-A-H11-2164, and JP-A-S60-240867.

Those fuel delivery pipes having the absorbing function of pulsation waves have an effect to reduce the pulsation wave generated in accompany with the fuel injection. In a case where the fuel delivery pipes are used for the in-line type engine, the eigenvalue described above tends to be relatively low, and the pulsation resonance point frequently comes out of the low rotation speed region of the engine.

In an opposed type engine, such as a horizontal opposed type or a V-type engine, in which: banks having plural cylinders are disposed parallel; fuel delivery pipes are disposed in the banks having the plural cylinders; a pair of the fuel delivery pipes are coupled via a connection pipe; and a part of the connection pipe or one fuel delivery pipe is directly coupled to the side of the fuel tank via the supplying pipe, the pulsation resonance frequently enters in the use rotary region of the engine. Even in the in-line type engine, the pulsation resonance may enter in the use rotary region of the engine where the supplying pipe is so short in relation to the arrangement of the fuel tank.

With a six cylinder opposed type engine in which the fuel delivery pipe itself has a pulsation absorption mechanism, it was experimentally confirmed that the pulsation resonance phenomenon occurs around a region of 2,000 to 4,000 rpm. Because this rotation speed region is within the range of normal use of the engine, the fuel injection is affected as described above to deviate the mixing rate of the fuel and the air, thereby producing an unfavorable result from a viewpoint to cleaning of exhaustion gas, a result that the engine may be suffered from a lower output, or a result that noises are introduced into the passenger compartment in the automobile via the supplying pipes.

In a three cylinder in-line engine in which the fuel delivery pipe itself has a pulsation absorption mechanism and in which the supplying pipe has a length approximately half of the ordinary length, it was experimentally confirmed that the pulsation resonance phenomenon occurs around a region of 1,000 rpm. Similarly to the above example, substantially the same disadvantages may occur because the point is within the rotational speed region of normal use of the engine.

Those resonance phenomena occur, as described above, from coincidence between a slow characteristic period of a pulsation wave characteristic to a fuel supply system located between the fuel tank and the fuel delivery pipe and an injection period of the injection nozzle. The generation of the resonation phenomenon in the in-line engine is controlled by the characteristic period of the pulsation between the fuel delivery pipe and the pressure adjusting valve in the fuel tank. On the other hand, the generation of the resonation phenomenon in the opposed type engine is controlled by the eigenfrequency of the pulsation between the fuel delivery pipe pair. In an ordinary four cycle engine, the following relation is found between this period and the rotation speed of the engine.

$$\text{Engine rotational speed [rpm]} = 1/(\text{characteristic period [sec]}) \times 60 \times (2/(\text{nozzle number in bank})) \quad \text{[Formula 1]}$$

The characteristic period may therefore be in a real use rotation region of the engine according to the number of the injection nozzles in the fuel delivery pipes.

A value analysis of the system is tried to find out what determines the characteristic period of the fuel supplying system. Where the propagation speeds of the pulsation waves in the respective structural components such as fuel delivery pipes, connection pipes, and supplying pipes in which the fuel for the system communicates, are previously sought, and where the value analysis of the wave equation is made in consideration of serial conditions relating to the flow rate and pressure to the boundary of the respective structural components, it was turned out that the characteristic period of the pulsation wave is controlled by the propagation speed of the pulsation wave in the fuel delivery pipes, the length of the fuel delivery pipes, and the fluid route cross-sectional area ratio of the fuel delivery pipe to the connection pipe or supplying pipe. In the in-line type engine, it was turned out that the length of the supplying pipe connecting the fuel delivery pipe and the pressure adjusting valve in the fuel tank does also affect greatly the characteristic period of the pulsation wave. In the opposed type engine having a pair of the fuel delivery pipes, the length of the connection pipe coupling between the pair of the fuel delivery pipes does also affect the characteristic period greatly.

The propagation speed of a pulsation wave in the above description is given as follows:

$$\alpha = [(1/\rho)/(1/Kf + 1/Kw)]^{0.5} \quad \text{[Formula 2]}$$

$\rho$: fuel density

Kf: fuel volume elastic modulus

Kw: volume elastic modulus of wall face of a fuel delivery pipe $Kw = (\Delta V/V)/\Delta P$ $\Delta P$: pressure fluctuation V: fuel delivery pipe volume $\Delta V$: volume fluctuation due to pressure fluctuation of the fuel delivery pipe The volume elastic modulus Kw of the fuel delivery pipe can be sought by a value calculation in use of a finite element method or the like. It turned out that the volume elastic modulus Kw of the fuel delivery pipe of shapes shown in FIG. 4 and FIG. 5 was about 70 Mpa according to the value analysis. Where the fuel density $\rho$ is 800 kg/m$^3$, where the volume elastic modulus Kf of the fuel is 1 GPa, and where the volume elastic modulus Kw of the fuel delivery pipe is 70 Mpa, the propagation speed of the pulsation wave in the fuel delivery pipe is about 290 m/s. This value is confirmed approximately as correct from experiments. In a meanwhile, where the volume elastic modulus of wall face of a fuel delivery pipe is set infinite with the above fuel density and volume elastic modulus, the propagation speed of the pulsation wave is about 1120 m/s. Accordingly, the volume elastic modulus of wall face of the fuel delivery pipe is remarkably larger than the fluid volume elastic modulus in an annular pipe, and because the reciprocal number of the volume elastic modulus Kw of wall face of the fluid or fuel delivery pipe is placed on a side of the denominator of the formula of the propagation speed of the pulsation wave, the effect from the volume elastic modulus Kw of wall face of a fuel delivery pipe can be neglected mostly. In an ordinary pipe having such as a circle cross section, therefore, the propagation speed of the pulsation wave is about 1100 m/s, and it is confirmed experimentally.

For example, in a system for an opposed type engine in which the propagation speed of the pulsation wave of the fuel is 1000 m/s, in which the propagation speed of the pulsation wave in the fuel delivery pipe is 290 m/s, in which the length of the fuel delivery pipe pair is 300 mm, in which the length of the connection pipe is 200 mm, and in which the fluid route cross-sectional area ratio of the fuel delivery pipe to the connection pipe is 0.1, a value solution of the pressure fluctuation in a case where the pressure fluctuation occurs in one fuel delivery pipe is sought, and when the change in pressure difference as time goes between the banks is sought, it is turned out as a sine wave, whose characteristic period is 14.3 ms. When a situation of a V6-engine, namely having three injection nozzles at each bank, is supposed, the pulsation resonance point is about 2,800 rpm according to the above formula [Formula 1].

In a system for an in-line type engine in which the propagation speed of the pulsation wave of the fuel is 1100 m/s, in which the propagation speed of the pulsation wave in the fuel delivery pipe is 290 m/s, in which the length of the fuel delivery pipe pair is 300 mm, in which the length of the supplying pipe is 1000 mm, and in which the fluid route cross-sectional area ratio of the fuel delivery pipe to the connection pipe is 0.1, a value solution of the pressure fluctuation in a case where the pressure fluctuation occurs in the fuel delivery pipe is sought, and when the change in pressure difference in the fuel delivery pipe as time goes is sought, it is turned out as a sine wave as a matter of course, whose characteristic period is 39.1 ms. When a three-cylinder engine is supposed, the pulsation resonance point is about 1,000 rpm according to the above formula.

THE DISCLOSURE OF THE INVENTION

This invention is for solving the above problems. Although various disadvantageous situations may be brought as described above where the pulsation resonance phenomenon exists in a desirable rotation region of normal use of an engine, the engine operation will not be adversely affected where the pulsation resonance phenomenon exists out of a desirable rotation region of normal use of an engine. In this invention, the pulsation resonance point can be shifted to an arbitrary rotational speed region by adjusting the characteristic period of the pulsation wave with the propagation speed of the pulsation wave in the fuel delivery pipe, or namely, at least one of the rigidity of the wall face of the fuel delivery pipe, the length of the fuel delivery pipe, the fluid route cross-sectional area ratio of the fuel delivery pipe to the connection pipe or the supplying pipe, and the length of the connection pipe or the supplying pipe.

With the invention, to solve the above problem, the first invention is characterized in a fuel supplying system, the system including: a plurality of fuel delivery pipes of a non-return type having no returning circuit to a fuel tank and having a plurality of injection nozzles; a plurality of banks having plural cylinders disposed in a horizontal opposed manner or a V type manner at the opposed type engine, the banks formed with the respective fuel delivery pipes; a connection pipe connecting between the fuel delivery pipe pair; and a supplying pipe connecting a portion on a fuel tank side with a part of the connection pipe or with directly the other fuel delivery pipe, wherein a period of a resonance phenomenon generated between a pair of the fuel delivery pipes with respect to the pulsation wave generated during fuel injections at the injection nozzles is controlled by at least one of a rigidity of a wall face of the fuel delivery pipe, a length of the fuel delivery pipe, a fluid route cross-sectional area ratio of the fuel delivery pipe to the connection pipe, and a length of the connection pipe, to render the period of the resonance phenomenon longer to shift a pulsation resonance point out of a low rotation region of the engine.

A second invention has a feature of a fuel supplying system, the system including: a plurality of fuel delivery pipes of a non-return type having no returning circuit to a fuel tank and having a plurality of injection nozzles; a plurality of banks having plural cylinders disposed in a horizontal opposed manner or a V type manner at the opposed type engine, the banks formed with the respective fuel delivery pipes; a connection pipe connecting between the fuel delivery pipe pair; and a supplying pipe connecting a portion on a fuel tank side with a part of the connection pipe or with directly the other fuel delivery pipe, wherein a period of a resonance phenomenon generated between a pair of the fuel delivery pipes with respect to the pulsation wave generated during fuel injections at the injection nozzles is controlled by at least one of a rigidity of a wall face of the fuel delivery pipe, a length of the fuel delivery pipe, a fluid route cross-sectional area ratio of the fuel delivery pipe to the connection pipe, and a length of the connection pipe, to render the period of the resonance phenomenon shorter to shift a pulsation resonance point out of a high rotation region of the engine.

A third invention has a feature of a fuel supplying system, the system including: a plurality of fuel delivery pipes of a non-return type having no returning circuit to a fuel tank and having a plurality of injection nozzles; a plurality of banks having plural cylinders disposed in a horizontal opposed manner or a V type manner at the opposed type engine, the banks formed with the respective fuel delivery pipes; a connection pipe connecting between the fuel delivery pipe pair via a communication choking pipe having an inner diameter smaller than that of the connection pipe; and a supplying pipe connecting a portion on a fuel tank side with a part of the connection pipe or with directly the other fuel delivery pipe, wherein a period of a resonance phenomenon generated between a pair of the fuel delivery pipes with respect to the pulsation wave generated during fuel injections at the injection nozzles is controlled by at least one of a fluid route cross-sectional area ratio of the communication choking pipe placed between the fuel delivery pipe and the connection pipe to the fuel delivery pipe, and a length of the communication choking pipe, to render the period of the resonance phenomenon longer to shift a pulsation resonance point out of a low rotation region of the engine.

In the first to third inventions, a pair of the fuel delivery pipe can be coupled with a pair of the connection pipes in a loop shape.

A fourth invention has a feature of a fuel supplying system, the system including: a fuel delivery pipe of a non-return type having no returning circuit to a fuel tank and having a plurality of injection nozzles; a plurality of banks having plural cylinders disposed in a horizontal opposed manner or a V type manner at the opposed type engine, the banks formed with the respective fuel delivery pipes; a branching pipe coupling respectively the fuel delivery pipe with the injection nozzle; and a supplying pipe connecting a portion on a fuel tank side with the fuel delivery pipe, wherein a period of a resonance phenomenon of the pulsation wave generated during fuel injections at the injection nozzles is controlled by at least one of a rigidity of a wall face of the fuel delivery pipe, a length of the fuel delivery pipe, a fluid route cross-sectional area ratio of the fuel delivery pipe to the supplying pipe, and a length of the supplying pipe, to render the period of the resonance phenomenon longer to shift a pulsation resonance point out of a low rotation region of the engine.

A fifth invention has a feature of a fuel supplying system, the system including:

an in-line type engine to which a plurality of cylinders is arranged; a fuel delivery pipe of a non-return type having no returning circuit to a fuel tank and having a plurality of injection nozzles disposed at the in-line type engine; and a supplying pipe connecting a portion on a fuel tank side with the fuel delivery pipe, wherein a period of a resonance phenomenon generated between the fuel delivery pipe and the fuel tank with respect to the pulsation wave generated during fuel injections at the injection nozzles is controlled by at least one of a rigidity of a wall face of the fuel delivery pipe, a length of the fuel delivery pipe, a fluid route cross-sectional area ratio of the fuel delivery pipe to the supplying pipe, and a length of the supplying pipe, to render the period of the resonance phenomenon longer to shift a pulsation resonance point out of a low rotation region of the engine.

A sixth invention has a feature of a fuel supplying system, the system including: an in-line type engine to which a plurality of cylinders is arranged; a fuel delivery pipe of a non-return type having no returning circuit to a fuel tank and having a plurality of injection nozzles disposed at the in-line type engine; and a supplying pipe connecting a portion on a fuel tank side with the fuel delivery pipe, wherein a period of a resonance phenomenon generated between the fuel delivery pipe and the fuel tank with respect to the pulsation wave generated during fuel injections at the injection nozzles is controlled by at least one of a rigidity of a wall face of the fuel delivery pipe, a length of the fuel delivery pipe, a fluid route cross-sectional area ratio of the fuel delivery pipe to the supplying pipe, and a length of the supplying pipe, to render the period of the resonance phenomenon shorter to shift a pulsation resonance point out of a high rotation region of the engine.

A seventh invention has a feature of a fuel supplying system, the system including: an in-line type engine to which a plurality of cylinders is arranged; a fuel delivery pipe of a non-return type having no returning circuit to a fuel tank and having a plurality of injection nozzles disposed at the in-line type engine; and a supplying pipe connecting a portion on a fuel tank side with the fuel delivery pipe, wherein a period of a resonance phenomenon generated between the fuel delivery pipe and the fuel tank with respect to the pulsation wave generated during fuel injections at the injection nozzles is controlled by at least one of a fluid route cross-sectional area ratio of a communication choking pipe placed between the fuel delivery pipe and the supplying pipe to the fuel delivery pipe, and a length of the communication choking pipe, to render the period of the resonance phenomenon longer to shift a pulsation resonance point out of a low rotation region of the engine.

The fuel delivery pipe may has a pulsation wave absorbing function for absorbing a pulsation wave generated during fuel injections at the injection nozzles.

The fuel delivery pipe may not has a pulsation wave absorbing function for absorbing a pulsation wave generated during fuel injections at the injection nozzles.

This invention, because thus constituted, with respect to an opposed type engine, is capable of shifting a pulsation resonance point out of a low rotation region favorable for normal use of the engine by connecting the fuel delivery pipe pair with the connection pipe, by connecting the supplying pipe with a part of the connection pipe or the other of the fuel delivery pipe, by coupling a fuel pump having a pressure adjusting valve formed in the fuel tank with the fuel delivery pipe, and by rendering the characteristic period of the pulsation wave generated between the fuel delivery pipe pair longer. Rendering longer the characteristic period of the pulsation wave can be done by making low the rigidity of the wall face of the fuel delivery pipe to reduce the propagation speed of the pulsation wave in the fuel delivery pipe, by making long the length of the fuel delivery pipe, by adjusting the fluid route cross-sectional area of the fuel delivery pipe, the connection pipe, or both as to make the fluid route cross-sectional area of the fuel delivery pipe larger than the fluid route cross-sectional area of the connection pipe, by making longer the length of the connection pipe, or by making a combination of the parameters as described above.

This invention also can make an adjustment as to shift a pulsation resonance point out of a high rotation region favorable for normal use of the engine by rendering shorter the characteristic period time of the pulsation wave generated between the fuel delivery pipe pair. Rendering shorter the characteristic period of the pulsation wave can be done by raising the rigidity of the wall face of the fuel delivery pipe to increase the propagation speed of the pulsation wave in the fuel delivery pipe, by making short the length of the fuel delivery pipe, by adjusting the fluid route cross-sectional area of the fuel delivery pipe, the connection pipe, or both as to make the fluid route cross-sectional area of the fuel delivery pipe smaller than the fluid route cross-sectional area of the connection pipe, by making shorter the length of the connection pipe, or by making a combination of the parameters as described above.

Conventionally, with an in-line type engine, a pulsation resonance is generated at a rotational speed around 500 rpm in use of fuel delivery pipes having an absorbing function of the pulsation wave, and the pulsation resonance point frequently exists out of a rotational speed region of 600 to 7,000 rpm as a favorable rotational speed region of the engine. Disadvantages generated from the pulsation resonance, therefore, can be avoided without any special design.

With an opposed type engine such as a V-type opposed type engine or horizontal opposed type engine in which banks constituted of plural cylinders are disposed parallel, however, the fuel delivery pipes of a non-return type are arranged parallel at the respective banks; the fuel delivery pipe pair is coupled with a connection pipe; and the connection pipe is coupled to a portion on a fuel tank side via a supplying pipe. With such an opposed type engine, it was confirmed experimentally as well as from numeral value computation that the pulsation resonance point occurs in the rotation region of the engine even where the fuel delivery pipe has the function for absorbing the pulsation wave.

Moreover, also with an in-line engine, it was confirmed experimentally as well as from numeral value computation that the characteristic period of the pulsation generated between the fuel delivery pipe and the pressure adjusting value in the fuel tank is made shorter where the length of the supplying pipe connecting between the fuel delivery pipe and the fuel tank is made shorter than the normal one and that the pulsation resonance point occurs in the rotation region of the engine.

With the fuel delivery pipe of the non-return type, a pulsation resonance phenomenon occurred in a range around 2,000 to 4,000 rpm in a six-cylinder opposed type engine where, e.g., the fuel delivery pipe itself having a pulsation wave absorption mechanism was used. Since this rotational speed region is in a range of the normal use of the engine, the fuel injection is affected as described above, thereby deviating the mixing rate of the fuel and the air and bringing unfavorable results from a view to cleaning of the exhaustion gas, or shortening the output of the engine, or resulting of introduction of noises into the automobile via the supplying pipe.

The rotational speed region as 2,000 to 4,000 rpm in the six-cylinder opposed type engine is equivalent to 20 to 10 ms when converted to the characteristic period according to the formula described above. A simple propagation period of a pulsation wave generated between the pair of the fuel delivery pipes is calculated as 4.5 ms with the example of the numerical computation described above (the characteristic period's calculated value is 14.3 ms in a system in which: the propagation speed of the pulsation wave in the fuel delivery pipe is 290 m/s; the length of the fuel delivery pipe is 300 mm; the propagation speed of the pulsation wave in the connection pipe is 1100 m/s; the length of the connection pipe is 200 mm; and the fluid route cross-sectional area ratio of the fuel delivery pipe to the connection pipe or supplying pipe is 0.1), and this characteristic period is remarkably large in comparison with the time for simple reciprocal movement of the pulsation wave in the system. That is, it is to be understood that the characteristic period of the pulsation wave is not from the simple reciprocal movement of the pulsation wave but is greatly influenced with reflection and transmission phenomenon at the boundary face between the fuel delivery pipe and the connection pipe or supplying pipe. The reflection coefficient R and the transmission coefficient T at the boundary face are given from the following formula.

$$R=(\chi-1)/(\chi+1) \qquad \text{[Formula 3]}$$

$$T=2/(\chi+1)$$

$$0\leqq R\leqq 1, 0\leqq T\leqq 1$$

$$\chi=rc/rA$$

$$rc=c\mathbf{1}/c\mathbf{2}$$

$$rA=A\mathbf{1}/A\mathbf{2}$$

c; propagation speed of pulsation wave

A; cross-sectional area

Subscript 1; on a side of the fuel delivery pipe, subscript 2; on a side of pipe The calculated results of the reflectance and the transmittance where the propagation speeds c1 of the pulsation waves in the fuel delivery pipe and in the connection pipe or supplying pipe are commonly 1100 m/s are shown in FIG. 7, and the calculated results where the propagation speed c1 of the pulsation wave in the fuel delivery pipe is 290 m/s are shown in FIG. 8 as an example that the fuel delivery pipe absorbs the pulsation from the elasticity thereof. In FIG. 7 and FIG. 8, numeral cl indicates the propagation speed of the pulsation wave on a side of the fuel delivery pipe; numeral c2 indicates the propagation speed of the pulsation wave on a side of the supplying pipe or the connection pipe. Numeral A1 indicates the cross-sectional area on a side of the fuel delivery pipe; numeral A2 indicates the cross-sectional area on a side of the supplying pipe or the connection pipe.

In FIG. 7, FIG. 8, the propagation speed c2 of the pulsation wave on a side of the pipe is set as 1100 m/s. The abscissa indicates the fluid route area ratio rA=A1/A2 of the fuel delivery pipe reference; the ordinate indicates the reflectance R and the transmittance T. If the fluid route area ratio is supposedly at around 0.1, the rate R is large even in FIG. 7 and FIG. 8. That is, it turned out that the pulsation wave is mostly reflected at this boundary face and a very small portion of the pulsation wave transmits. Particularly, as shown in FIG. 8, in a case of a fuel delivery pipe absorbing by itself the pulsation from elastic transformation, namely numeral c1 is at 290 m/s, the rate R is about 0.95 (or the rate T is about 0.05). That is, the pulsation wave is transmitted only around 5%. Therefore, it is understood that the pressure fluctuation generated locally in the fuel delivery pipe reaches the pressure adjusting value in the fuel tank little by little as becoming the pulsation wave, and that the pulsation wave is reversed very slowly in comparison with the propagation speed of the pulsation wave.

In the in-line type engine, it is presumed that the pulsation wave from this injection becomes the pulsation wave having a slow period with respect to the tank. It is understood that the resonance phenomenon is generated when the pulsation wave coincides to the injection period at the fuel delivery pipe.

On the other hand, in the opposed type engine, successive injections are made for each bank alternatively, and therefore, local pressure fluctuation in the fuel delivery pipe occurs periodically and alternatively at each bank, so that the compulsive pressure fluctuation determined by this period exists. At that time, a pulsation wave having a period much larger than the period reciprocating between the pair of the fuel delivery pipes with respective propagation speeds, exists between the pair of the fuel delivery pipes via the connection pipe in substantially the same way as the pulsation wave between the fuel tank and the fuel delivery pipe in the in-line type engine. The pulsation waves between the fuel tank and the respective fuel delivery pipes also exist in overlapping the above pulsation wave. Their components are smaller than that of the pulsation wave between the pair of the fuel delivery pipes, and hardly raise a problem during actual engine operation. The period of the pulsation wave between the pair of the fuel delivery pipes can be confirmed by seeking changes as time goes in the pressure difference in the pair of the fuel delivery pipes to compensate the overlapped pulsation wave components with respect to the tank.

Therefore, in a case of the in-line engine, the pulsation wave is constituted as including the long supplying pipe extending below the floor and has a relatively long period. The pulsation resonance point of the conventional in-line type engine was therefore below the desirable rotation speed region for the normal use of the engine, so that the disadvantages from generation of the pulsation resonance were not created.

Even in the in-line engine, however, the length of the system constituting the pulsation wave may be shortened according to the position where the fuel tank and the engine are placed, thereby rendering higher the eigenfrequency to reach the rotation region for the normal use of the engine. In such a case, it is assumed that the pulsation resonance phenomenon may occur in a region near a low rotation region, so-called an idling rotation. Therefore, if the pulsation wave raises a problem in the in-line type engine, it is effective to shift the resonance point to the idling rotation or less by extending the period of the pulsation wave.

On the other hand, though the pulsation wave is frequently constituted of the connection pipe and the pair of the fuel delivery pipes in the opposed type engine, the V-type opposed type engine has a short connection pipe and relatively short period, so that the pulsation resonance phenomenon occurs in a relatively high rotation region. The horizontal opposed type engine has a longer connection pipe, and as a consequence, the period of the pulsation wave becomes relatively longer, so that the pulsation resonance phenomenon is recognizable in a relatively low rotation region. When the pulsation resonance raises a problem in the opposed type engine, conceivable plans are to shift the pulsation resonance point to a higher region than the use range of the engine by shortening the period of the pulsation wave according to the length of the connection pipe or to shift the pulsation wave to a region equal to or less than the idling rotation by extending the period of the pulsation wave.

In respect to the opposed type engine, analyzed results of influences regarding propagation speed of the pulsation wave, length, and cross-sectional area ratio from analysis using numerical calculation of the pulsation wave generated between the fuel delivery pipe pair are shown in FIG. 9 to FIG. 14. In any of FIG. 9 to FIG. 14, fixed parameters in each drawing are shown in the drawings. The ordinate indicates the period of the pulsation wave, and circled marks indicate the calculated results. As shown in FIG. 9, the characteristic period of the pulsation wave in the opposed type engine is inversely proportioned approximately to the propagation speed of the pulsation wave in the fuel delivery pipe. That is, where the rigidity of the fuel delivery pipe is lowered and where the absorbing ability of the pulsation wave is raised, the propagation speed of the pulsation wave is reduced as well as the characteristic period is made longer, and as a result, the pulsation period can be extended.

As shown in FIG. 10, the propagation speed of the pulsation wave in the connection pipe and the supplying pipe does not affect the characteristic period of the pulsation wave in the opposed type engine. The characteristic period of the pulsation wave in the opposed type engine is proportioned to the square root of the length of the fuel delivery pipe as shown in FIG. 11 and is also proportioned to the square root of the connection pipe as shown in FIG. 12. Therefore, the characteristic period of the pulsation wave can be made longer by extending the length of the fuel delivery pipe or extending the length of the connection pipe, and as a result, the pulsation resonance period can be made longer. However, the length of the supplying pipe has no effect as shown in FIG. 13.

The characteristic period of the pulsation wave in the opposed type engine is inversely proportioned approximately to the square root of the cross-sectional area ratio ([fluid route cross-sectional area of the connection pipe]/[fluid route cross-sectional area of the fuel delivery pipe])as shown in FIG. 14. Therefore, the characteristic period of the pulsation wave can be made longer by increasing the cross-sectional area of the fuel delivery pipe or decreasing the cross-sectional area of the connection pipe, thereby consequently rendering longer the pulsation resonance period. FIG. 15 shows correlation between the experimental results and the numerical calculation results of the pulsation wave about the opposed type engine under the same conditions. FIG. 15 indicates the period of the pulsation wave corresponding to the length of the connection pipe. In FIG. 15, where the white circles show the experimental data, and where the black triangles show the calculated data, it turned out that both data mostly coincide to each other. Accordingly, the analysis from the numerical calculation results as described above is deemed as usable for control of the pulsation resonance period of the opposed type engine, and in order to lower the pulsation resonance point, it is controllable by reducing the rigidity of the fuel delivery pipe to lower the propagation speed of the pulsation wave, making longer the fuel delivery pipe, making longer the connection pipe, enlarging the fluid route cross section of the fuel delivery pipe, rendering smaller the fluid route cross section of the connection pipe, and making a combination of those.

Conversely, in order to increase the pulsation resonance point, it is controllable by increasing the rigidity of the fuel delivery pipe to raise the propagation speed of the pulsation wave, making shorter the fuel delivery pipe, making shorter the connection pipe, making smaller the fluid route cross section of the fuel delivery pipe, rendering larger the fluid route cross section of the connection pipe, and making a combination of those.

In respect to the opposed type engine, results analyzed in substantially the same manner where a pair of the connection pipes is coupled between the fuel delivery pipe pair in a loop shape are shown in FIG. 16 to FIG. 20. In any of FIG. 16 to FIG. 20, fixed parameters in each drawing are shown in the drawings. The ordinate indicates the period of the pulsation wave, and circled marks indicate the calculated results. The influences on the respective parameters such as propagation speed of the pulsation wave and length are the same as those of the previous example, that is, the example that the fuel delivery pipe pair is coupled with the sole connection pipe, but the period of the pulsation wave is made smaller as around two thirds of the previous one. FIG. 16 shows influences on the propagation speed of the pulsation wave in the fuel delivery pipe, and corresponds to FIG. 9 described above. FIG. 17 shows influences on the length of the fuel delivery pipe, and corresponds to FIG. 11 described above. FIG. 18 shows influences on the length of the connection pipe, and corresponds to FIG. 12 described above. FIG. 19 shows influences on the fluid route cross-sectional area ratio of the fuel delivery pipe and the connection pipe, and corresponds to FIG. 14 described above. FIG. 20 shows correlation between the experimental results and the numerical calculation results of the pulsation wave about the opposed type engine under the same conditions, and corresponds to FIG. 15 described above, but both data approximately coincide to each other in substantially the same way as in FIG. 15. Accordingly, though the pulsation resonance point is controllable in the same way as described above, the characteristic period is about two thirds as described above, or namely, the pulsation resonance point is multiplied by one and a half, so that the connection pipe structure in the loop shape is suitable for shifting the pulsation resonance point out of the high rotation region of the engine.

In substantially the same manner, the in-line engine was analyzed with a numerical calculation of the pulsation wave generated between the fuel delivery pipe and the fuel tank. The analyzed results in influences on propagation speed of the pulsation wave, length, and cross-sectional area ratio are shown in FIG. 21 to FIG. 25. In any of FIG. 21 to FIG. 25, fixed parameters in each drawing are shown in the drawings. The ordinate indicates the period of the pulsation wave, and circled marks indicate the calculated results.

As shown in FIG. 21, the characteristic period of the pulsation wave in the in-line type engine is approximately inversely proportioned to the propagation speed of the pulsation wave in the fuel delivery pipe. That is, the characteristic period of the pulsation wave can be made longer by lowering the rigidity of the fuel delivery pipe to raise the absorption ability of the pulsation wave and to reduce the propagation speed of the pulsation wave, and as a result, the pulsation resonance period can be made longer. The propagation speed of the pulsation wave in the supplying pipe has almost no effect in the characteristic period of the pulsation wave in the in-line engine as shown in FIG. 22. The characteristic period of the pulsation wave in the in-line type engine is substantially proportioned to the square root of the length of the fuel delivery pipe as shown in FIG. 23 and is also proportioned to the square root of the supplying pipe as shown in FIG. 24. Therefore, the characteristic period of the pulsation wave can be made longer by extending the length of the fuel delivery pipe or extending the length of the supplying pipe, and as a result, the pulsation resonance period can be made longer.

The characteristic period of the pulsation wave in the in-line type engine is inversely proportioned approximately to the square root of the cross-sectional area ratio ([fluid route cross-sectional area of the supplying pipe]/[fluid route cross-sectional area of the fuel delivery pipe]) as shown in FIG. 25. Therefore, the characteristic period of the pulsation wave can be made longer by increasing the cross-sectional area of the fuel delivery pipe or decreasing the cross-sectional area of the supplying pipe, thereby consequently rendering longer the pulsation resonance period. FIG. 26 shows correlation between the experimental results and the numerical calculation results of the pulsation wave about the in-line type engine under the same conditions, and it turned out that both data mostly coincide to each other. Accordingly, the analysis from the numerical calculation results as described above is deemed as usable for control of the pulsation resonance period of the in-line type engine, and in order to lower the pulsation resonance point, it is controllable by reducing the rigidity of the fuel delivery pipe to lower the propagation speed of the pulsation wave, making longer the fuel delivery pipe, making longer the supplying pipe, enlarging the fluid route cross section of the fuel delivery pipe, rendering smaller the fluid route cross section of the supplying pipe, and making a combination of those.

THE BEST MODE FOR EMPLOYING THE INVENTION

Figure 1:
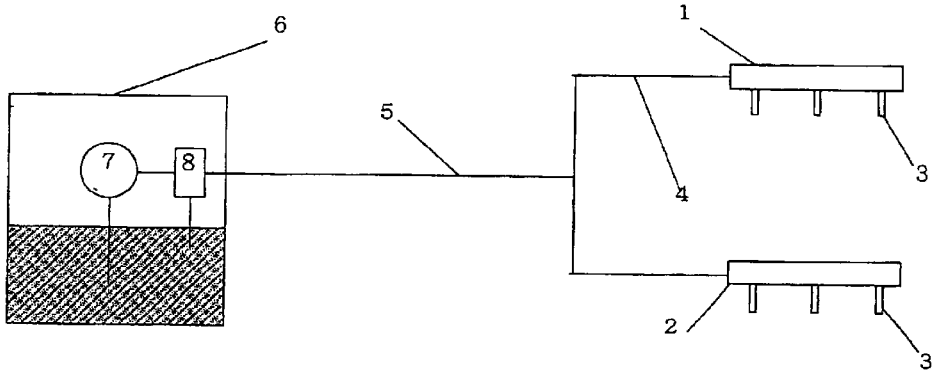
FIG. 1 is a system diagram showing a positional relation of a fuel delivery pipe pair, a connection pipe, and a supplying pipe in an opposed type engine.

Embodiments of the invention are described. Based on a structure at an experiment described with FIG. 15, a description is made. In an opposed type engine, as shown in FIG. 1, injection nozzles (3) are mounted three pieces for each pipe at a pair of fuel delivery pipes (1), (2). The length of the fuel delivery pipes (1), (2) were 315 mm in the experiment. In the experiment, the injection nozzles were opened on the injection side. The pair of the fuel delivery pipes (1), (2) were coupled with a connection pipe (4). The connection pipe (4) was in a cylindrical pipe having an outer diameter of 8 mm and a thickness of 0.7 mm, whose length was of four kinds, 210 mm, 700 mm, 2600 mm, and 3200 mm. An intermediate point of the connection pipe (4) was connected to a supplying pipe (5). The supplying pipe (5) was in a cylindrical pipe having an outer diameter of 8 mm, a thickness of 0.7 mm, in the same way as the connection pipe (4), and a length of 2000 mm. A tip of the supplying pipe (5) is coupled to a fuel tank (6). In the fuel tank (6), a pressure adjusting valve (8) is connected to an outlet of a fuel pump (7), and the supplying pipe (5) is coupled to the pressure adjusting valve (8).

Figure 3:
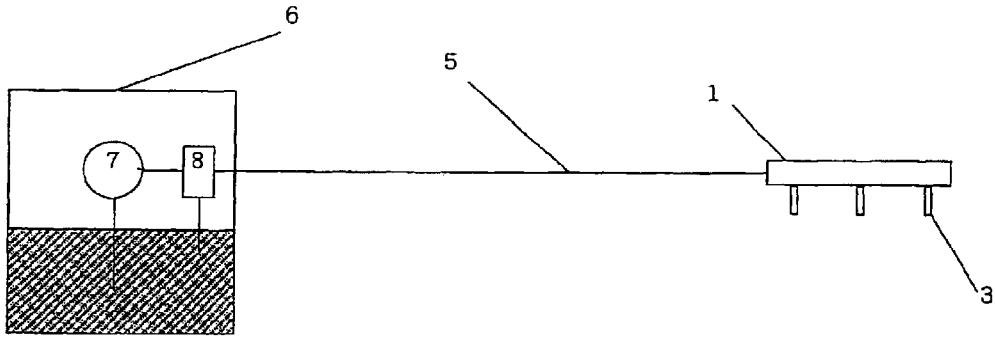
FIG. 3 is a system diagram showing a positional relation of a fuel delivery pipe pair, a connection pipe, and a supplying pipe in an in-line type engine.
Figure 26:
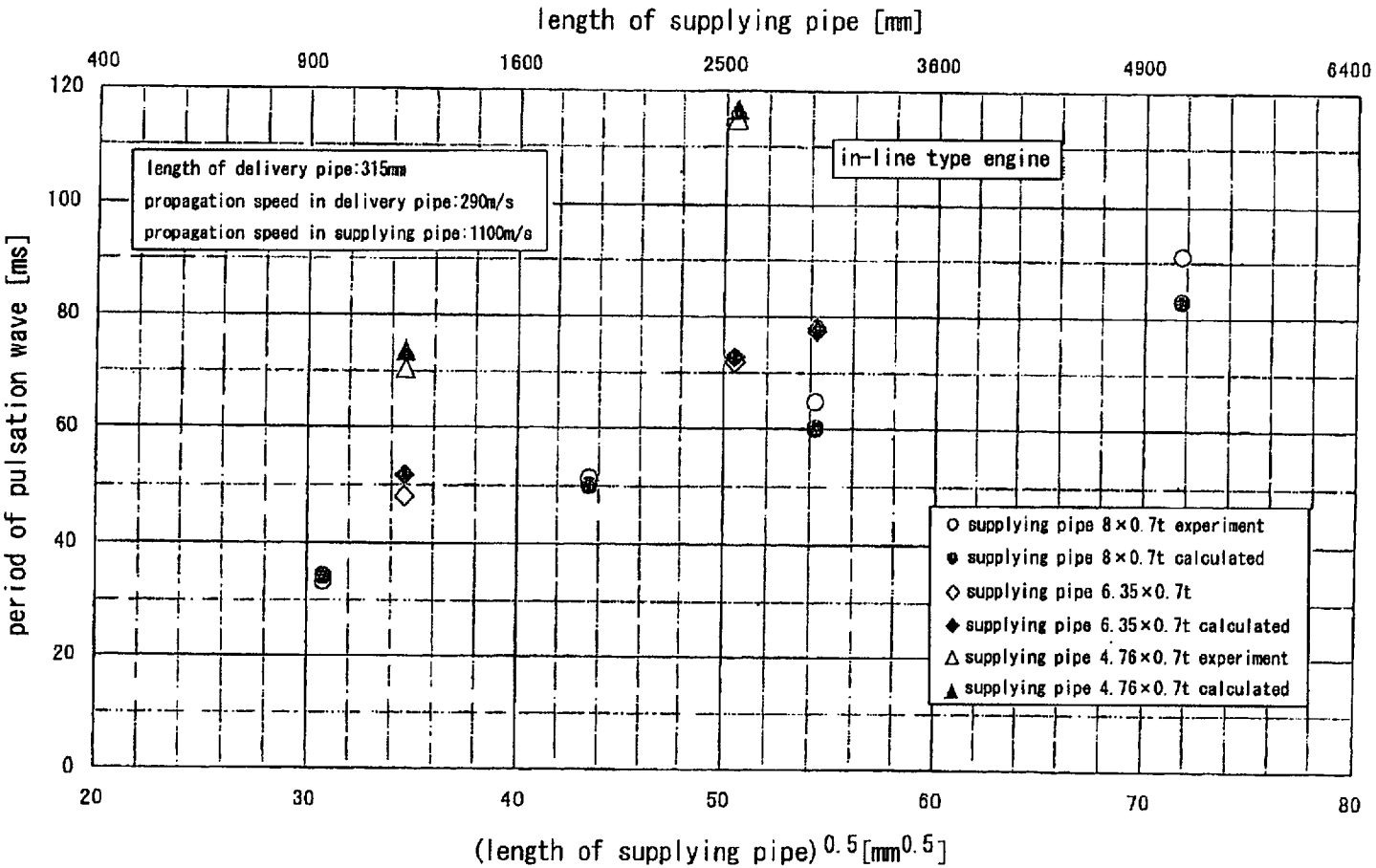
FIG. 26 is a characteristic diagram showing a correlation between the numerical calculations and the experimental values of the pulsation wave between the fuel delivery pipe and the fuel tank in an in-line type engine.

Next, regarding an in-line engine, based on a structure at a time of the experiment described in FIG. 26 a description is made. As shown in FIG. 3, three of the injection nozzles (3) were mounted to the fuel delivery pipe (1). The length of the fuel delivery pipe (1) was 315 mm as the same as the opposed type. The fuel delivery pipe (1) is coupled to the supplying pipe (5). The supplying pipe (5) has a cylinder with any of an outer diameter of 8 mm and a thickness of 0.7 mm, an outer diameter of 6 mm and a thickness of 0.7 mm, or an outer diameter of 4.76 mm and a thickness of 0.7 mm, whose length was 950 mm to 5200 mm. The supplying pipe (5) has a tip coupled to the fuel tank (6). In the fuel tank (6), a pressure adjusting valve (8) is connected to an outlet of a fuel pump (7), and the supplying pipe (5) is coupled to the pressure adjusting valve (8).

Figure 4:
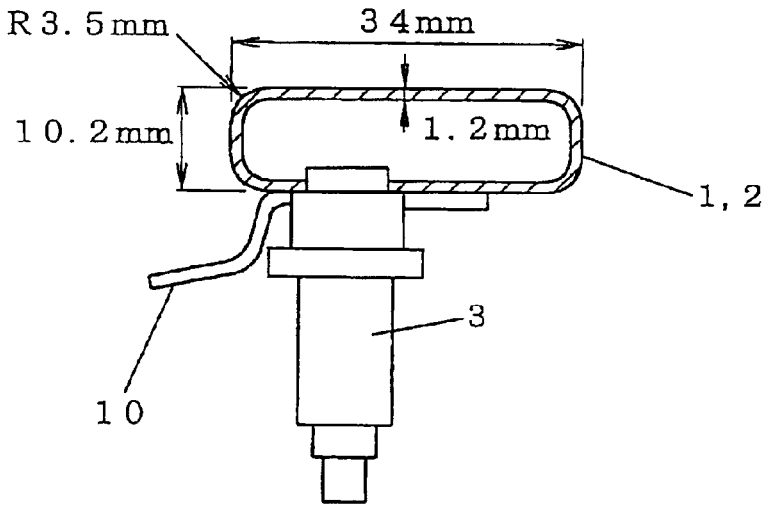
FIG. 4 is a fluid route cross-sectional view of a fuel delivery pipe having a partly flat cross section capable of absorbing pulsation waves with elasticity of a wall face.
Figure 5:
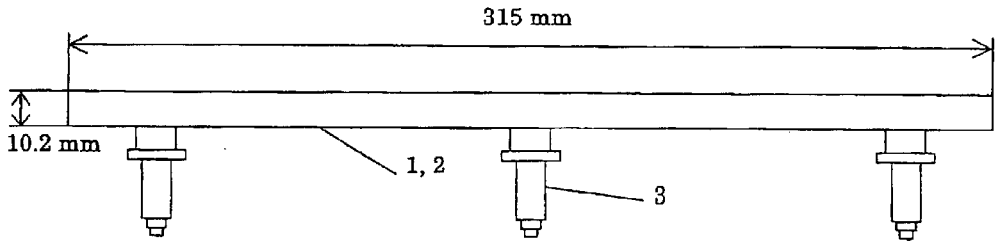
FIG. 5 is a side view of a fuel delivery pipe shown in FIG. 4.

Detailed sizes of the fuel delivery pipes (1), (2) are described using FIG. 4 and FIG. 5. The cross-sectional shape of the fuel delivery pipes (1), (2) is partly flat as shown in FIG. 4 in having a width of 34 mm and a height of 10.2 mm with outer face's rounded corners of 3.5 mm in diameter. The length of the fuel delivery pipes was 315 mm as described above. Injection nozzles (3) in accordance with the cylinder number are attached to the fuel delivery pipes (1), (2), and are attached to a bracket (10) to be secured to the engine. Where a volume elastic coefficient was sought by a numerical analysis with this shape, it was about 70 Mpa, and where a propagation speed of the pulsation wave was sought with Formula 2 described above, it was about 290 m/s. If the width of the fuel delivery pipe is reduced from 34 mm to 28 mm, the elastic coefficient becomes about 150 Mpa from a numerical analysis, and the propagation speed of the pulsation wave is consequently raised to 400 m/s. The propagation speeds of those pulsation waves were confirmed as substantially correct from phase shifts of the reflection waves in the experiment.

Figure 15:
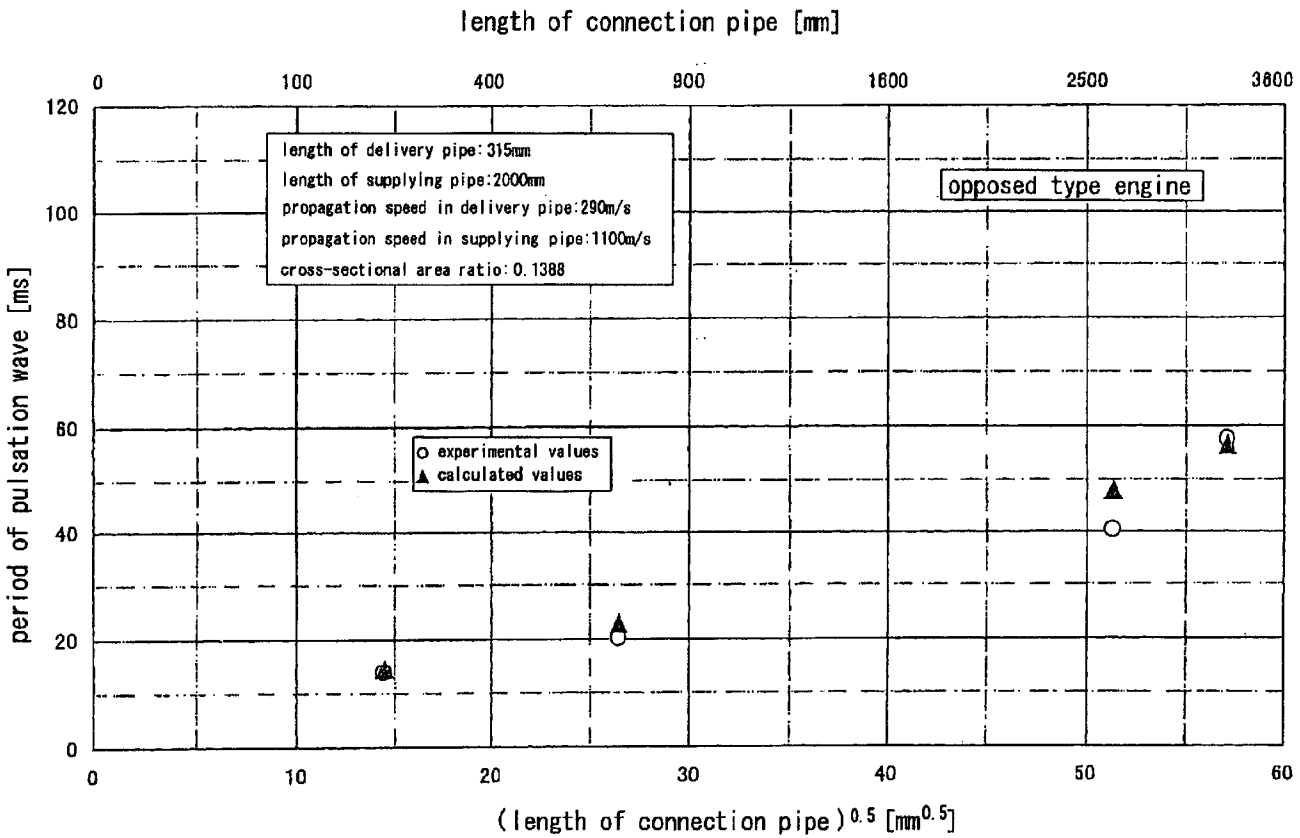
FIG. 15 is a characteristic diagram showing a correlation between the numerical calculations and the experimental values of the pulsation wave between the fuel delivery pipe pair in an opposed type engine.
Figure 16:
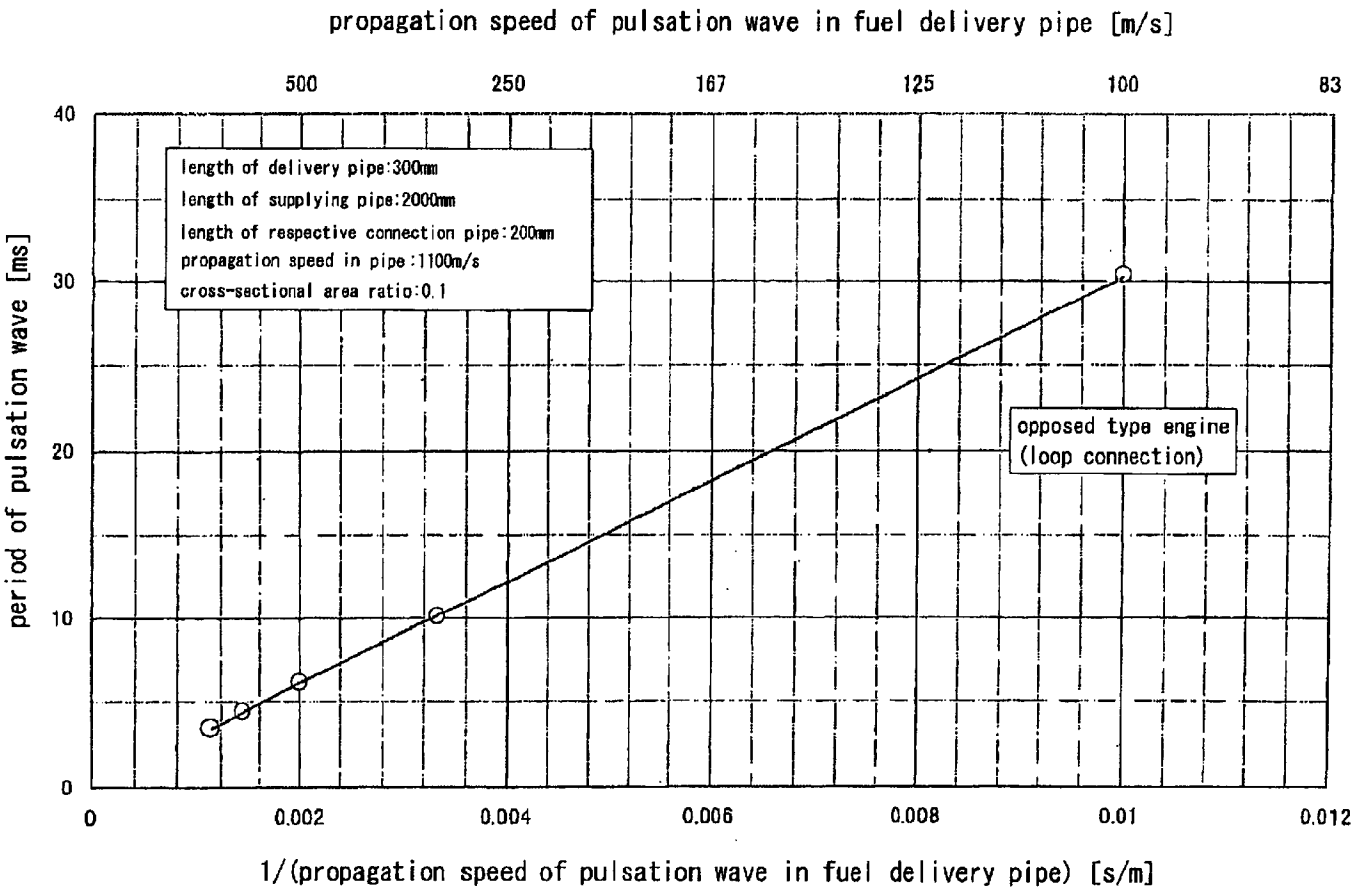
FIG. 16 is a characteristic diagram showing depending property to the propagation speed of the pulsation wave in the fuel delivery pipe of the pulsation wave between the fuel delivery pipe pair in an opposed type engine whose connection pipe is in a loop pair shape.
Figure 17:
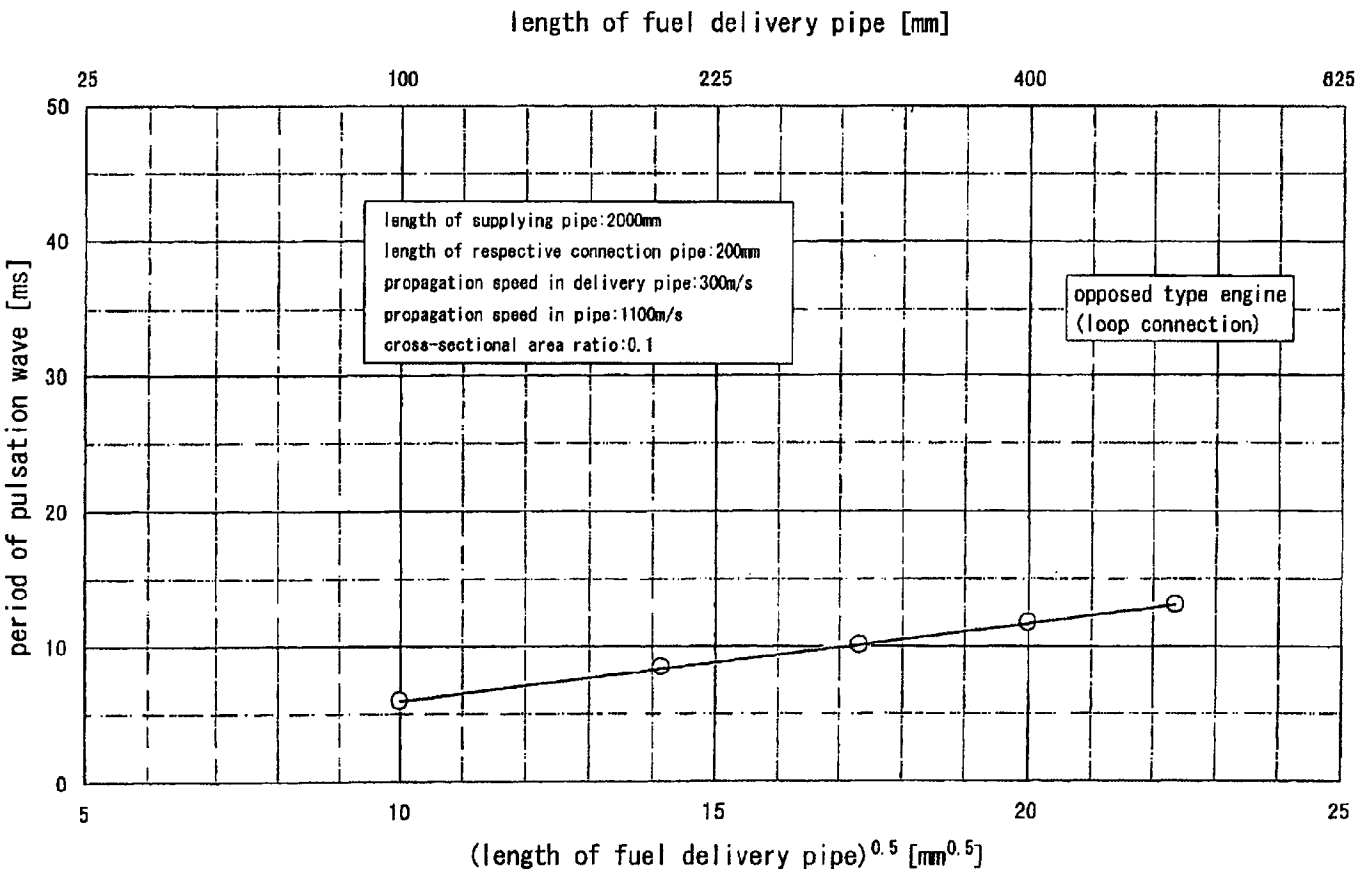
FIG. 17 is a characteristic diagram showing depending property to the fuel delivery pipe length of the pulsation wave between the fuel delivery pipe pair in an opposed type engine whose connection pipe is in a loop pair shape.
Figure 18:
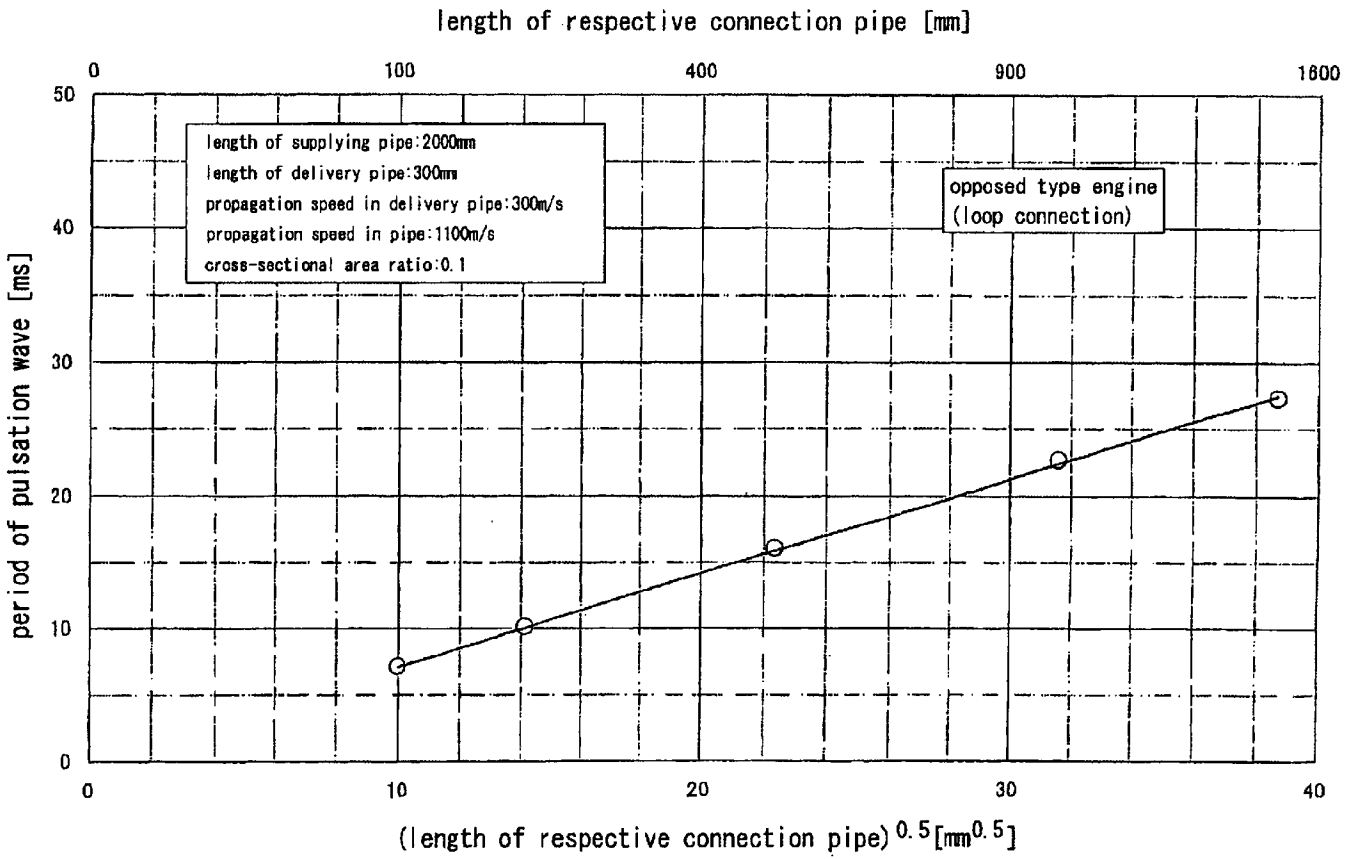
FIG. 18 is a characteristic diagram showing depending property to the connection pipe length of the pulsation wave between the fuel delivery pipe pair in an opposed type engine whose connection pipe is in a loop pair shape.

An actual example of the resonance point and an example of control of the resonance point, in the opposed type engine, are described. In a case of a V-type engine in which the fuel delivery pipes (1), (2) having a volume elastic modulus of 70 Mpa and a propagation speed of the pulsation wave of 290 m/s have a length of 315 mm, and in which the connection pipe (4) having an outer diameter of 8 mm and a thickness of 0.7 mm has a length of 210 mm, as shown in FIG. 15, the characteristic period of the pulsation wave with this structure was 13.9 ms as a result of the experiment. In a case of six-cylinder engine, namely each bank having three cylinders, the pulsation resonance point is about 2880 rpm from Formula 3 described above.

To shift the engine rotation number to a high rotation side, e.g., 7,000 rpm, the characteristic period of the pulsation wave is needed to be multiplied by 0.41. As an example, where the width of the fuel delivery pipes (1), (2) is changed from 34 mm to 28 mm and the volume elastic modulus is set to about 150 MPa, the characteristic period of the pulsation wave is set to 5.6 ms, or namely the resonance point is shifted to around 7100 rpm in the V6 engine by setting the propagation speed of the pulsation wave to be 400 m/s, the length of the fuel delivery pipes (1), (2) to be 300 mm, and the connection pipe (4) to be an outer diameter of 12 mm and a thickness of 0.9 mm. Conversely, where the engine rotation is shifted to a low rotation, e.g., 700 rpm, the characteristic period of the pulsation wave is necessarily multiplied by 4.11. As an example, where the width of the fuel delivery pipes (1), (2) is unchanged at 34 mm but the length is extended to be 330 mm, the eigenvalue of the pulsation wave is set to 58 ms, or namely the-resonance point is shifted to around 690 rpm in the V6 engine by setting the connection pipe (4) to be an outer diameter of 4.76 mm, a thickness of 0.7 mm, and a length of 1100 mm.

Figure 2:
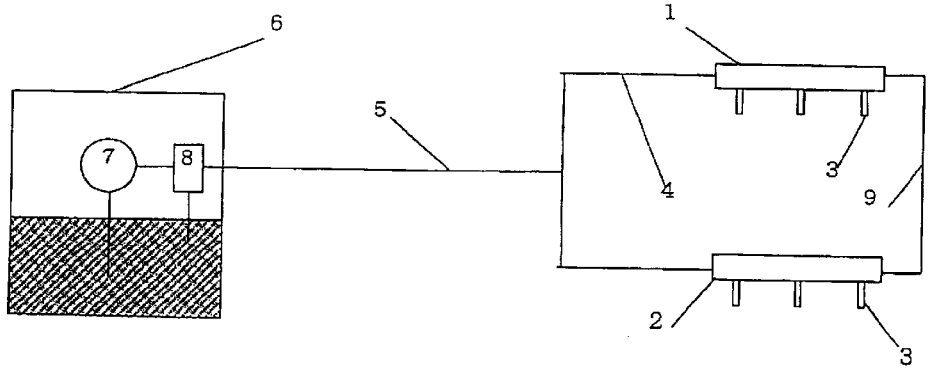
FIG. 2 is a system diagram of an embodiment in which the connection pipe and the fuel delivery pipe are coupled in a loop shape.

In another embodiment, to shift the resonance point out of a high rotation region of the engine, the resonance point can be raised about one and a half times by structuring a loop shape using a pair of the connection pipes (4). This method is as shown in FIG. 2 for connecting a first connection pipe (4) and a second connection pipe (9) to the opposite ends of the fuel delivery pipes (1), (2) having a width of 35 mm and structuring a loop made of the fuel delivery pipes (1), (2) and a pair of the connection pipes (4), (9). The propagation speed of the pulsation wave in the fuel delivery pipes (1), (2) is set to 290 m/s, and the length is set to 315 mm. The length of the connection pipes (4), (9) is set to 210 mm, and the length of the supplying pipe (5) is formed as 2,000 mm. The connection pipes (4), (9) and the supplying pipe (5) were of an outer diameter of 8 mm and a thickness of 0.7 mm. In this structure, the characteristic period of the pulsation wave is 9.4 ms from the numerical analysis, and namely, the resonance point becomes around 4260 rpm.

The characteristic period of the pulsation wave is set to 5.5 ms, or namely the resonance point is shifted to 7270 rpm, by setting the width of the fuel delivery pipes (1), (2) to 28 mm to render the propagation speed of the pulsation wave 400 m/s and by changing the connection pipe pair (4), (9) from one having the outer diameter of 8 mm and the thickness of 0.7 mm to one having the outer diameter of 10 mm and the thickness of 0.7 mm.

Figure 19:
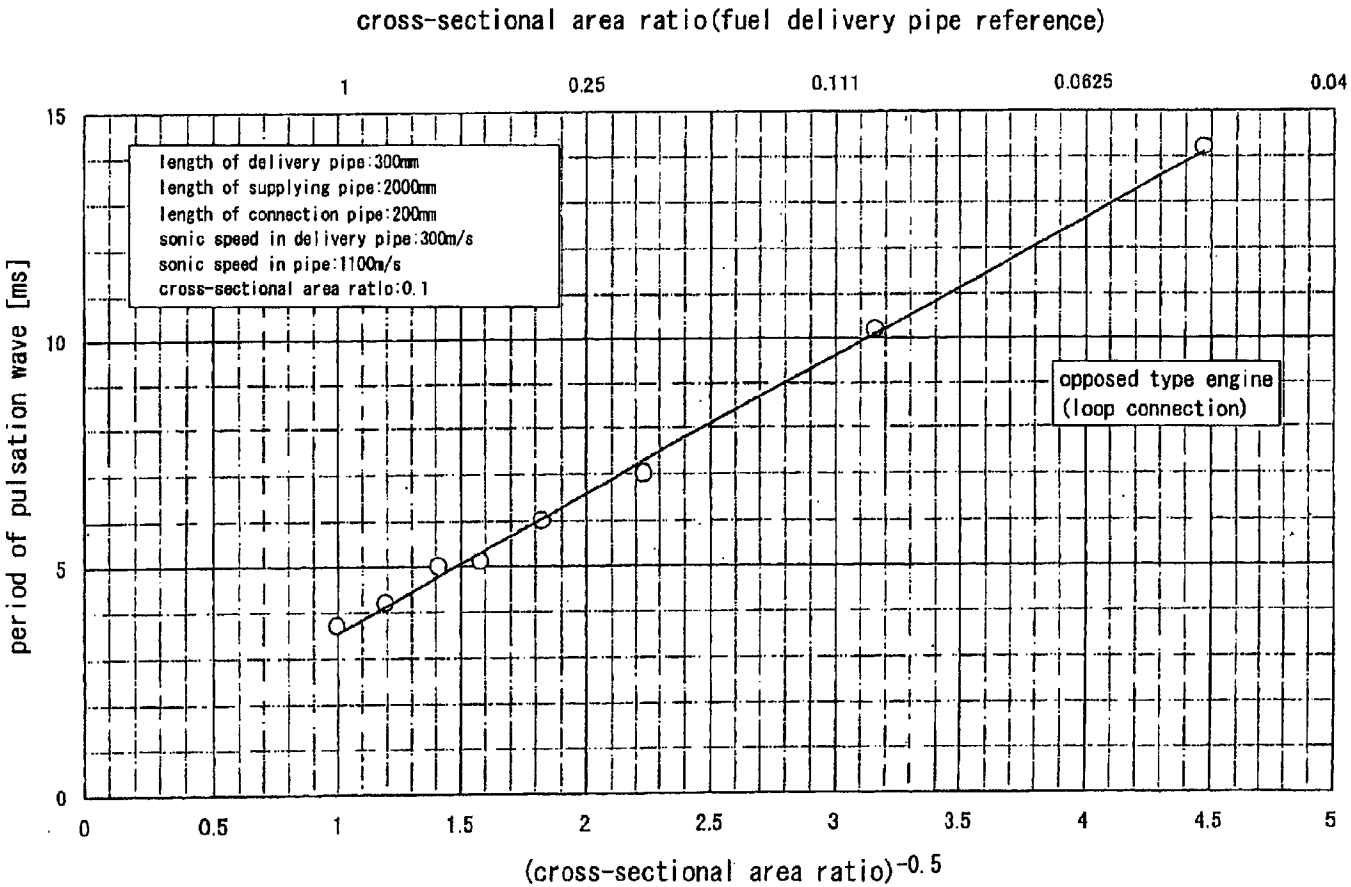
FIG. 19 is a characteristic diagram showing depending property to the fluid route cross-sectional area ratio at a boundary face between the fuel delivery pipe and the connection pipe of the pulsation wave between the fuel delivery pipe pair in an opposed type engine whose connection pipe is in a loop pair shape.
Figure 20:
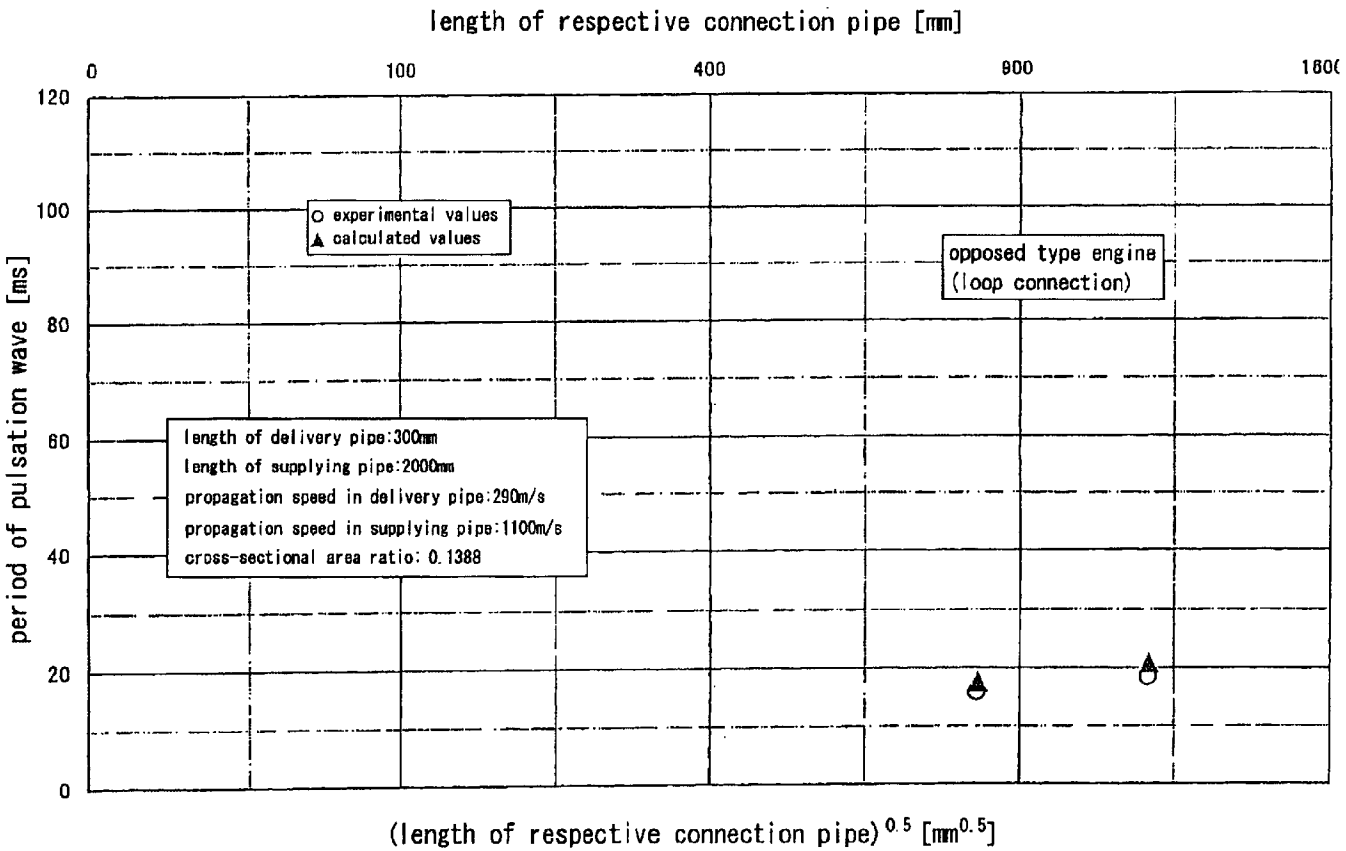
FIG. 20 is a characteristic diagram showing a correlation between the numerical calculations and the experimental values of the pulsation wave between the fuel delivery pipe pair in an opposed type engine whose connection pipe is in a loop pair shape.
Figure 21:
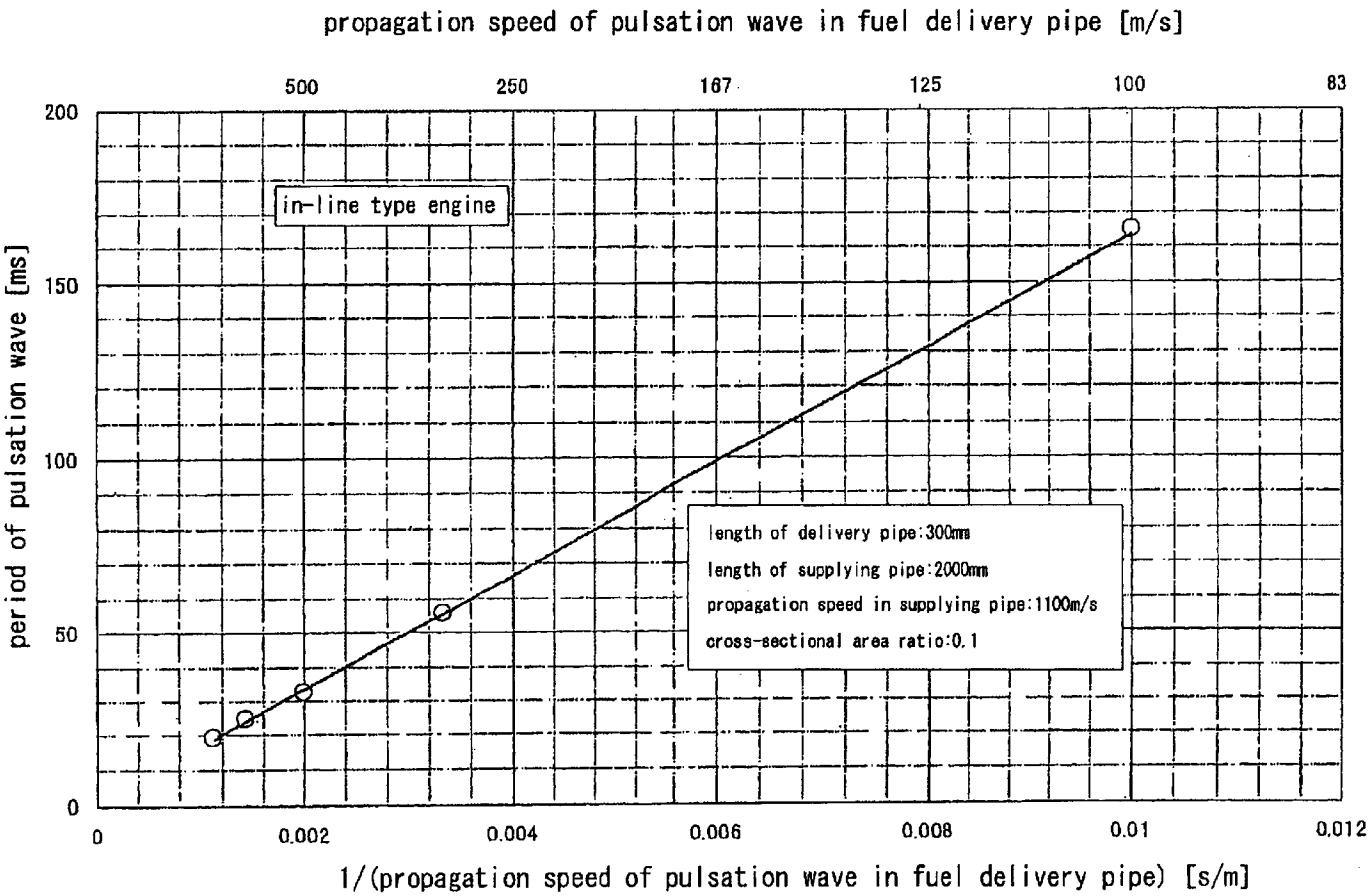
FIG. 21 is a characteristic diagram showing depending property to the propagation speed of the fuel delivery pipe pulsation wave of the pulsation wave between the fuel delivery pipe and the fuel tank in an in-line type engine.
Figure 22:
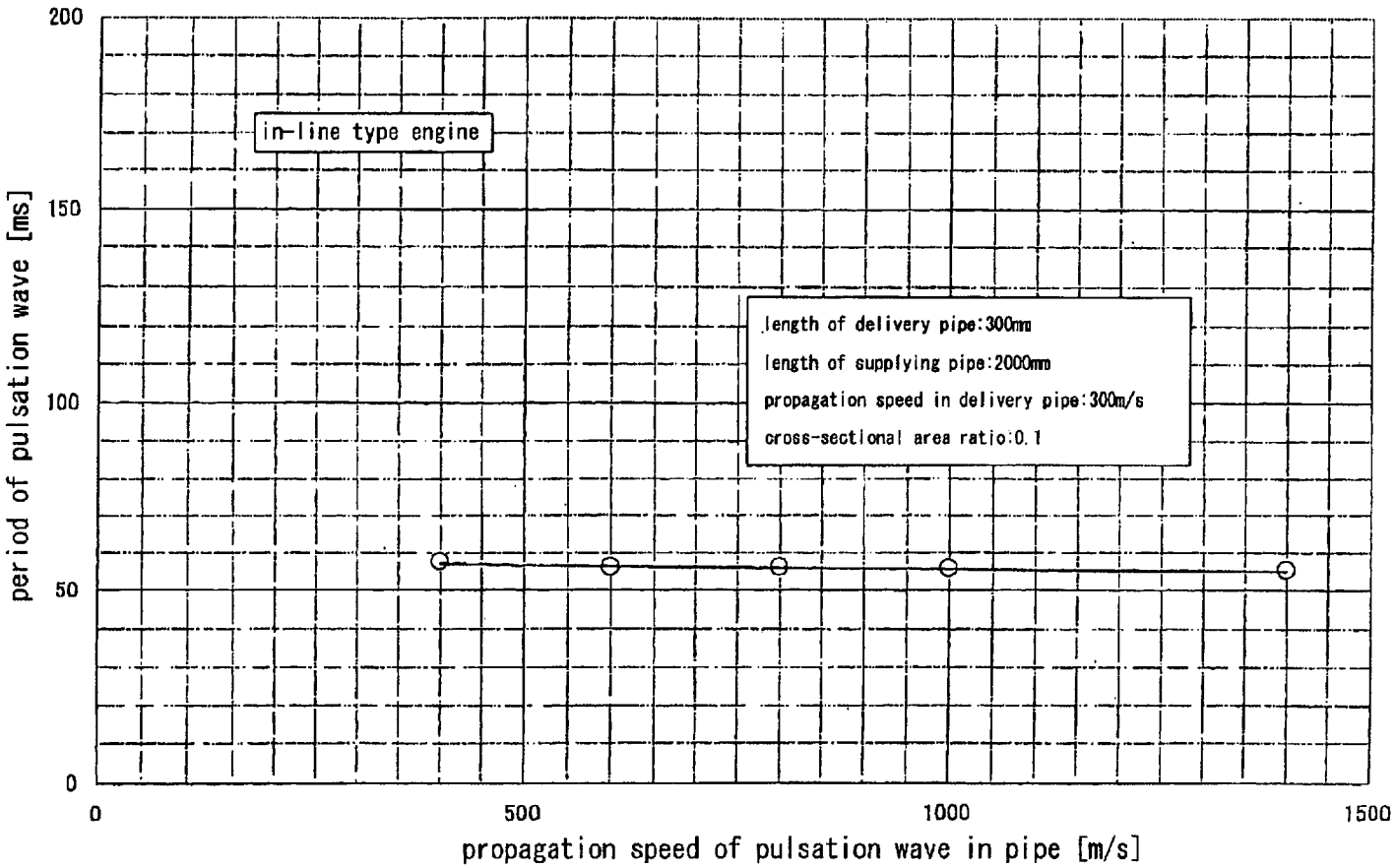
FIG. 22 is a characteristic diagram showing depending property to the propagation speed of the pulsation wave of the supplying pipe of the pulsation wave between the fuel delivery pipe and the fuel tank in an in-line type engine.
Figure 23:
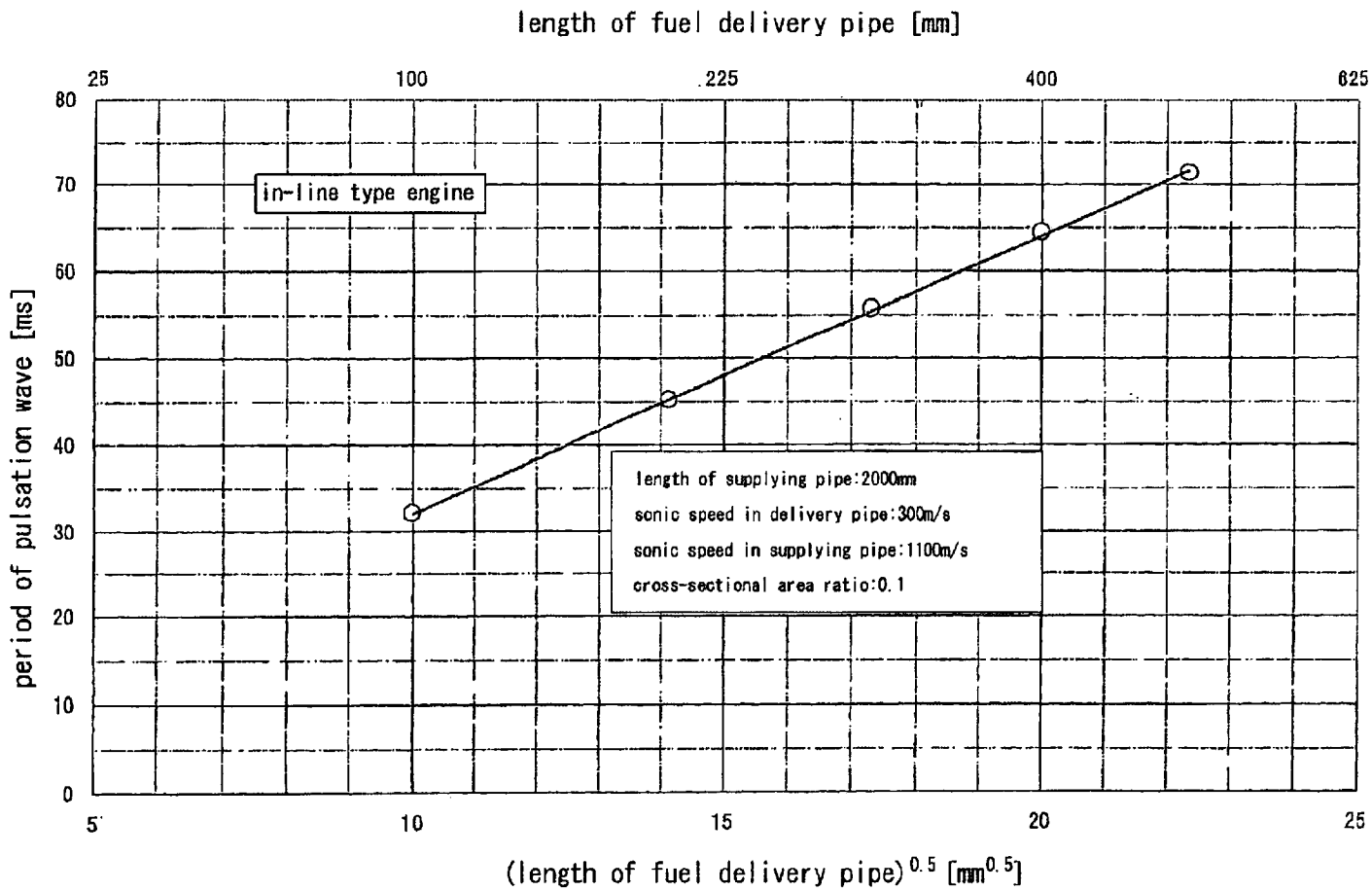
FIG. 23 is a characteristic diagram showing depending property to the fuel delivery pipe length of the pulsation wave of the pulsation wave between the fuel delivery pipe and the fuel tank in an in-line type engine.
Figure 24:
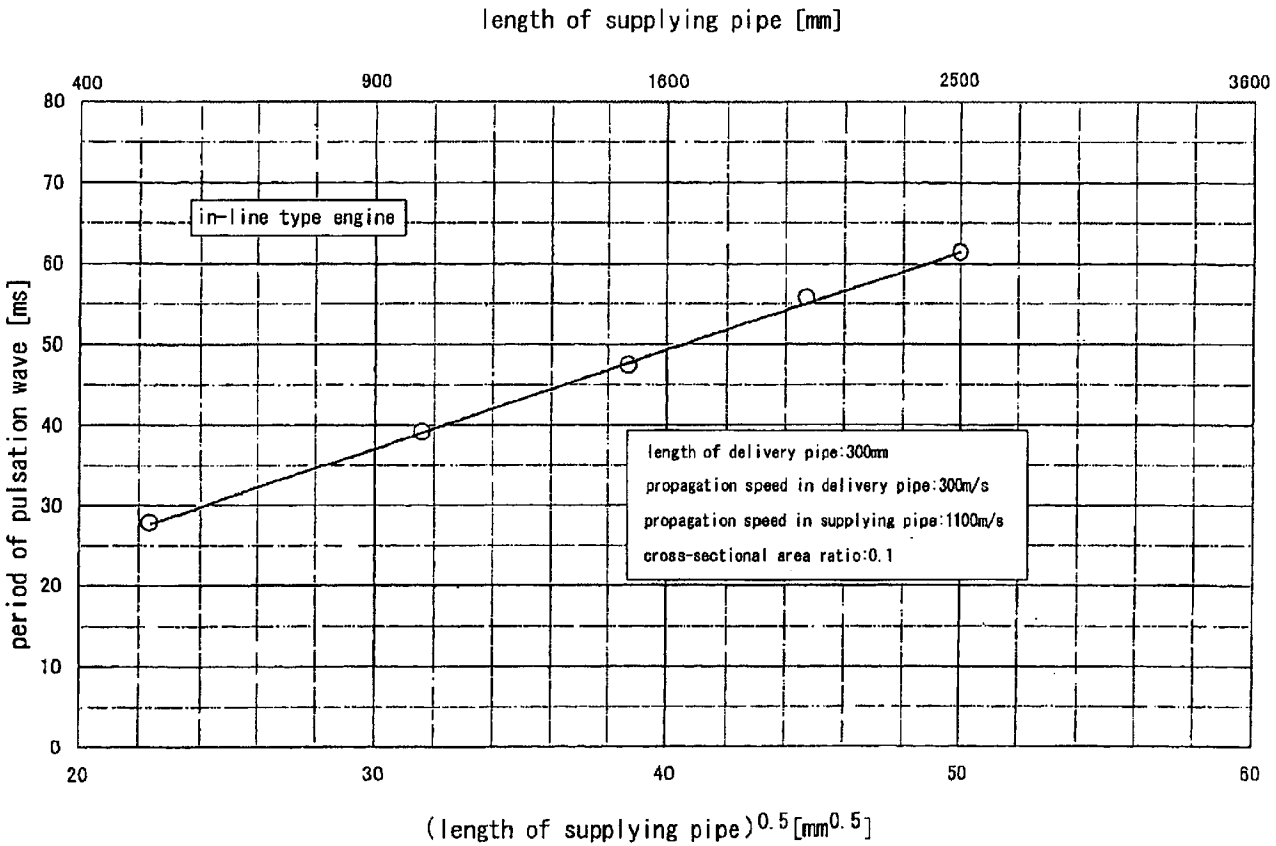
FIG. 24 is a characteristic diagram showing depending property to the supplying pipe length of the pulsation wave of the pulsation wave between the fuel delivery pipe and the fuel tank in an in-line type engine.
Figure 25:
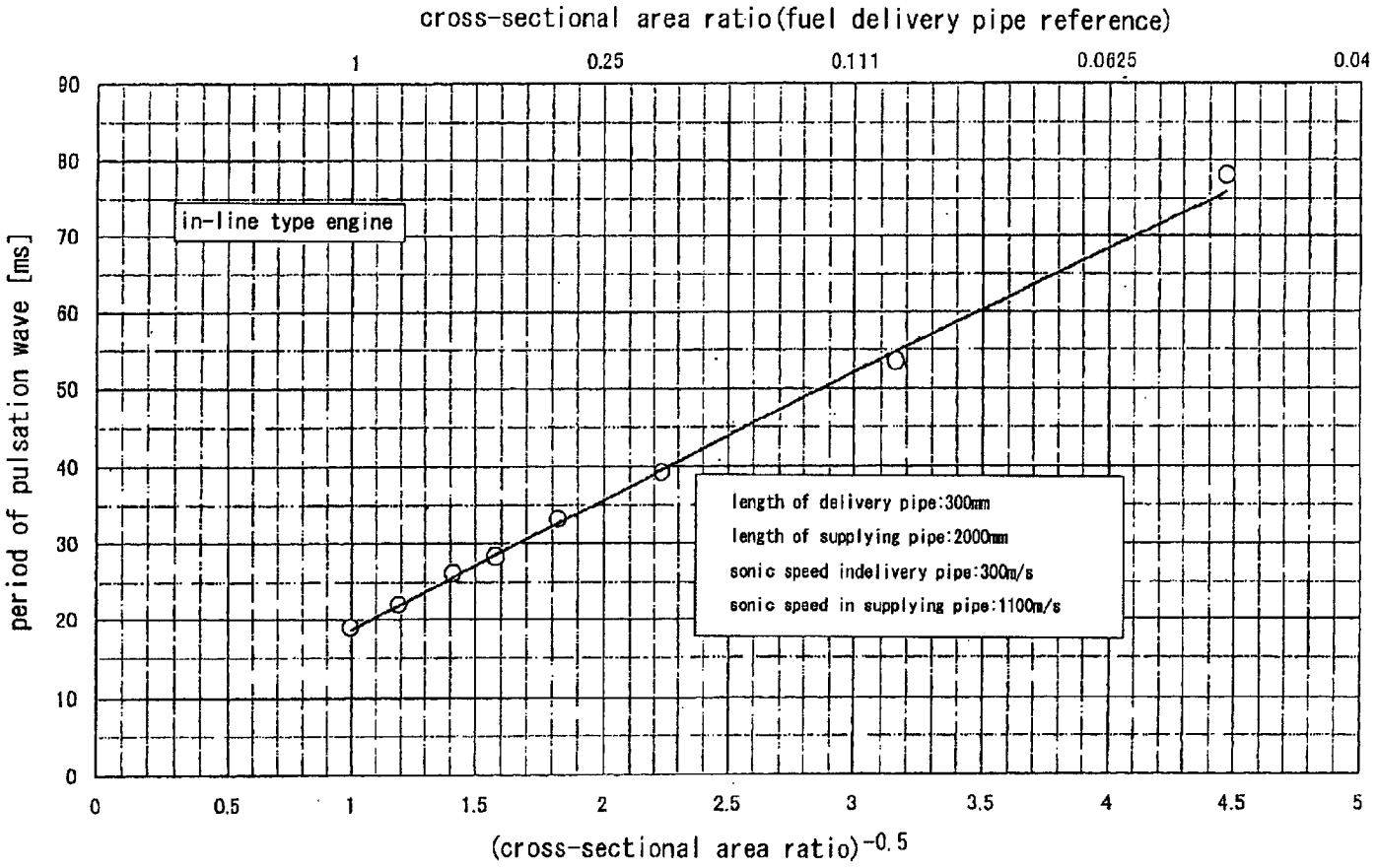
FIG. 25 is a characteristic diagram showing depending property to the fluid route cross-sectional area ratio at a boundary face between the fuel delivery pipe and the supplying pipe of the pulsation wave between the fuel delivery pipe and the fuel tank in an in-line type engine.

Next, an actual example of the resonance point and an example of control of the resonance point, in the in-line type engine, are described. In a case of an in-line three-cylinder engine in which the fuel delivery pipe (1) having a volume elastic modulus of 70 Mpa, or namely a propagation speed of the pulsation wave of 290 m/s, has a length of 315 mm, and in which the supplying pipe (5) having an outer diameter of 8 mm and a thickness of 0.7 mm has a length of 1900 mm, as shown in FIG. 19, the characteristic period of the pulsation wave was 51.3 ms as a result of the experiment. In a case of three-cylinder engine, the pulsation resonance point is about 780 rpm from Formula 1 described above. To shift the engine rotation number to a low rotation side, e.g., 700 rpm, the characteristic period of the pulsation wave is needed to be multiplied by 1.11 from 780 rpm divided by 700 rpm. As an example, where the supplying pipe (5) is changed to have the outer diameter of 6.35 mm and the thickness of 0.7 mm, the eigenvalue of the pulsation wave is set to 68 ms, or namely the resonance point is shifted to around 590 rpm in the in-line four-cylinder engine.

Figure 27:
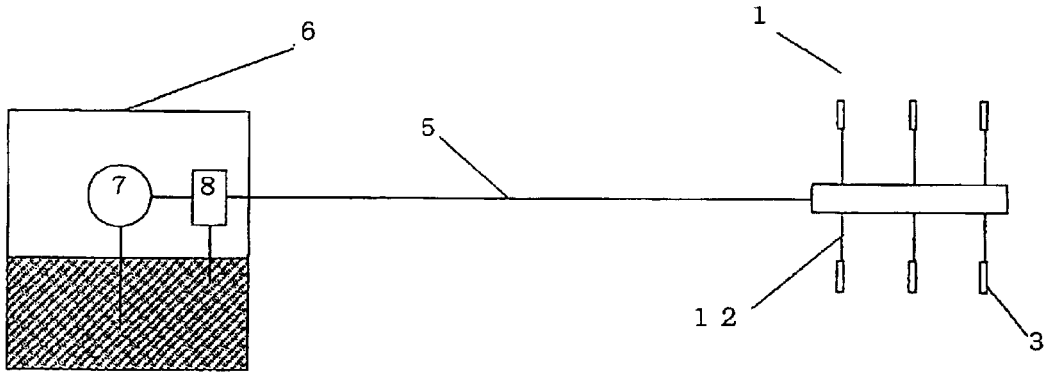
FIG. 27 is a system diagram of an opposed engine where injection nozzles of the respective banks are coupled with a fuel delivery pipe.

As another embodiment of an opposed type engine, as shown in FIG. 27, described is a structure that the respective nozzles (3) of each bank of the opposed type engine in which banks made of plural cylinders are disposed in a manner of a horizontal opposed type or a V-type, are coupled to a sole fuel delivery pipe (1) via a branching pipe (12). In this embodiment, the connection pipe is unnecessary even for the opposed type engine of such as a horizontal opposed type or a V-type. The fuel delivery pipe (1) is partly flat in the same manner as the previous example, having a width of 34 mm, a height of 10.2 mm, rounded outer corners of 3.5 mm diameter, and a length of 315 mm. Where the supplying pipe (5) is formed of a cylindrical pipe of an outer diameter of 8 mm and a thickness of 0.7 mm with a length of 1900 mm, the characteristic period of the pulsation wave is of 51.3 ms as shown in FIG. 19. In a six-cylinder engine of the opposed type, the pulsation resonance point is 390 rpm, and the resonance point can be shifted out of the use region.

Figure 6:
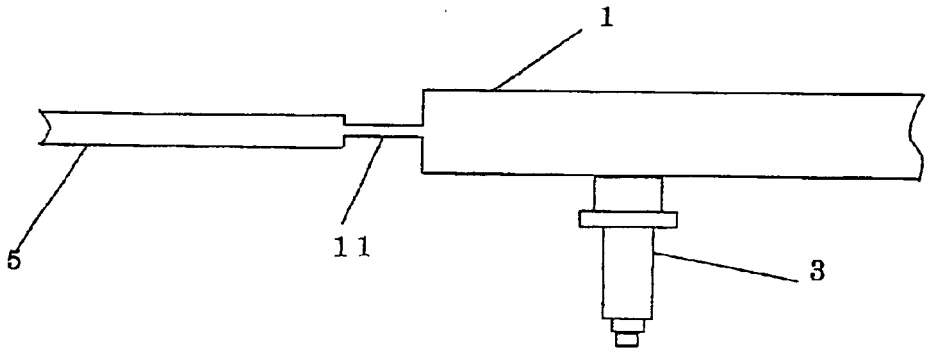
FIG. 6 is a side view showing an arrangement that a choking pipe is disposed between the fuel delivery pipe and a pipe.
Figure 7:
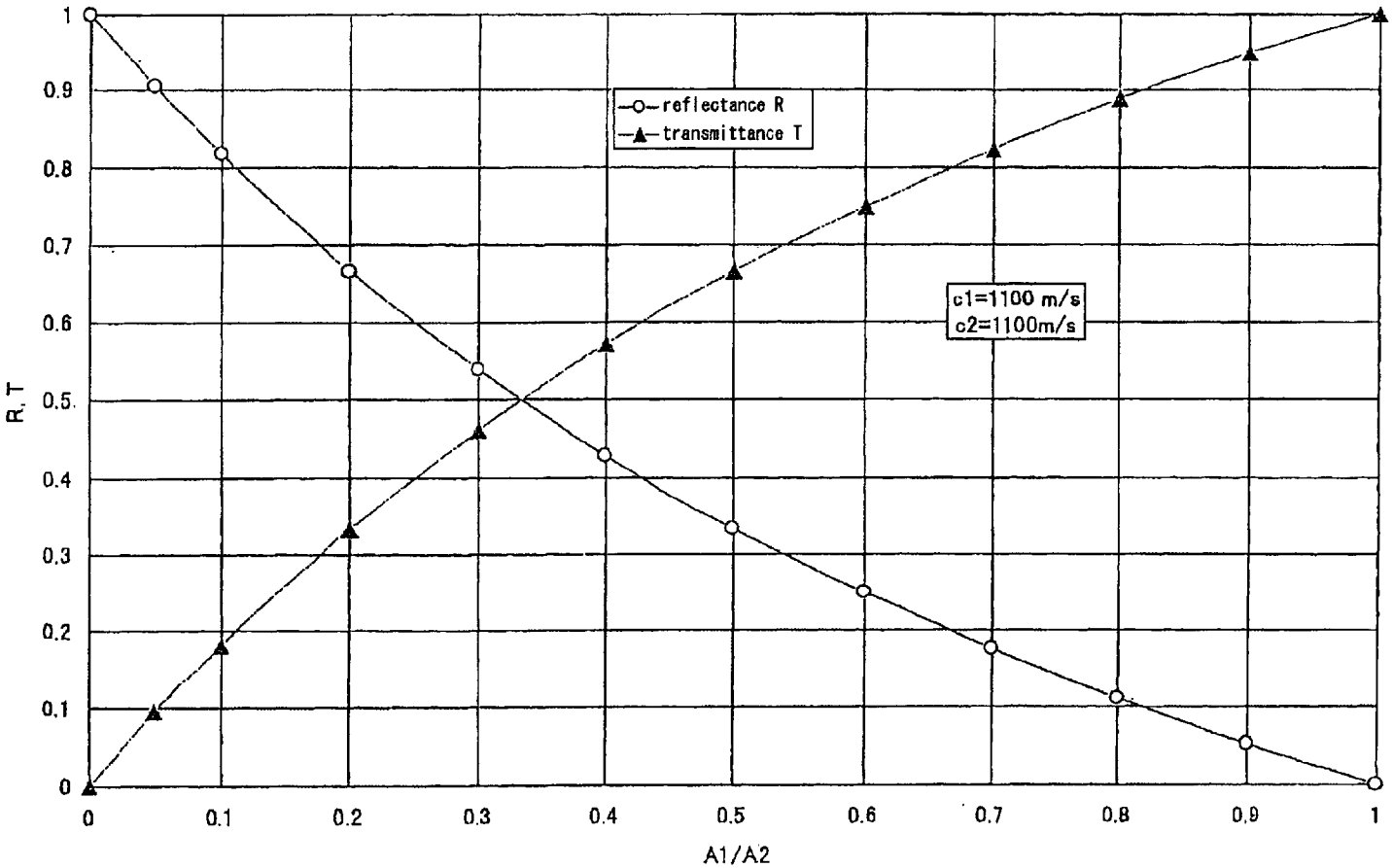
FIG. 7 is a characteristic diagram showing depending property of the fluid route cross-sectional area ratio of reflection and transmission coefficients of the pulsation waves at a boundary face between the fuel delivery pipe and the pipe.
Figure 8:
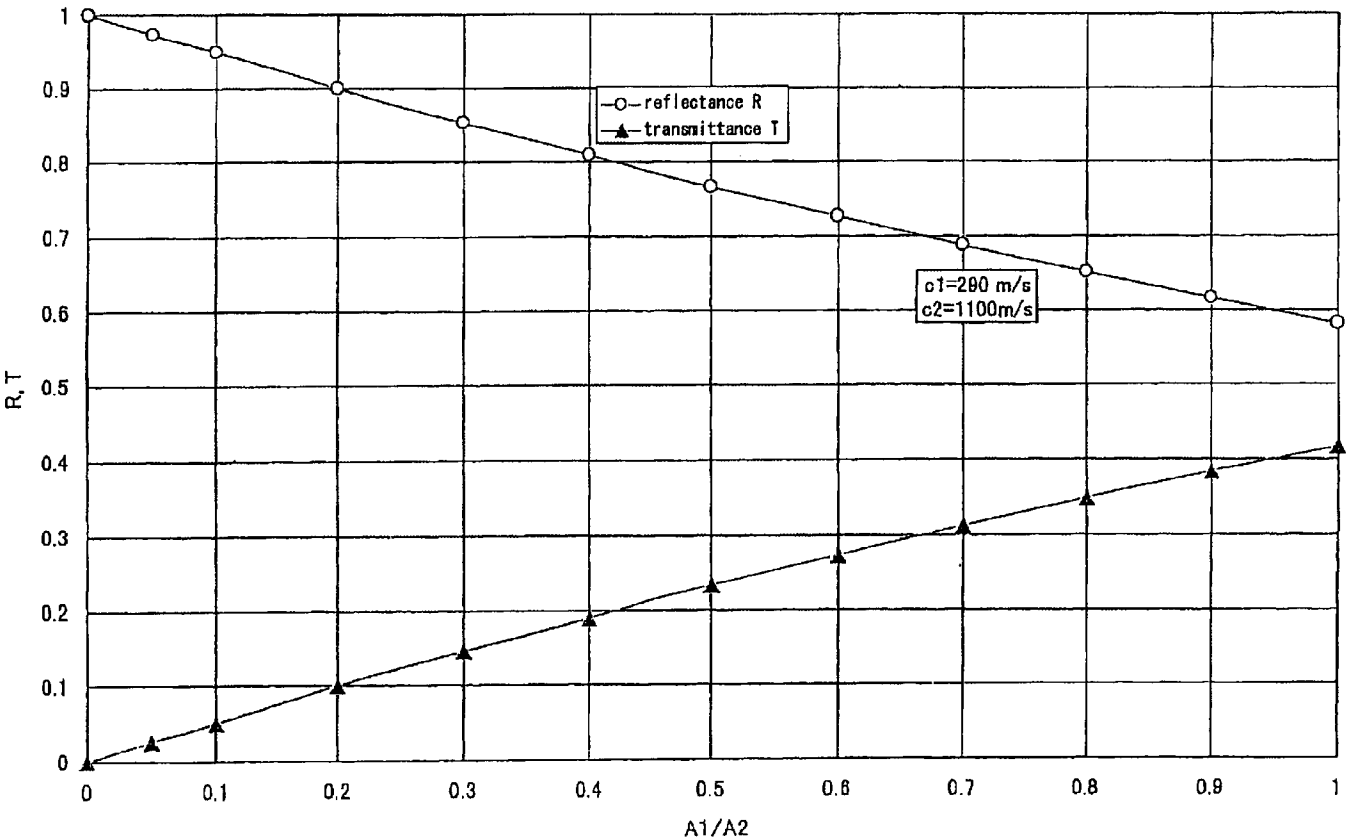
FIG. 8 is a characteristic diagram showing depending property of the fluid route cross-sectional area ratio of reflection and transmission coefficients of the pulsation waves at a boundary face between the fuel delivery pipe having a partly flat cross section and having a small volume elastic modulus resulting a low propagation speed of the pulsation wave and the pipe.
Figure 9:
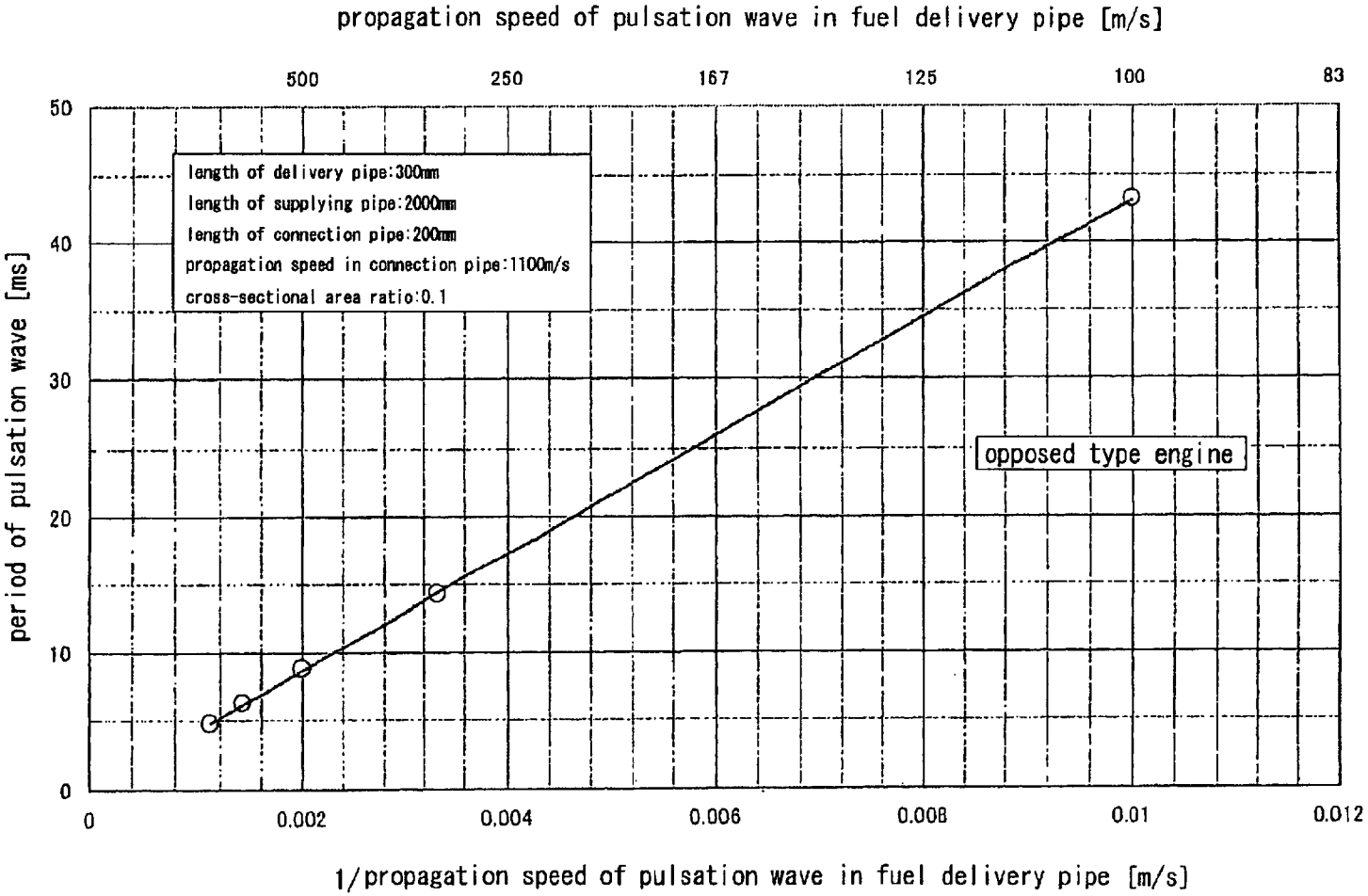
FIG. 9 is a characteristic diagram showing depending property of the pulsation wave between the fuel delivery pipe pair in an opposed type engine to the propagation speed of the fuel delivery pipe pulsation wave.
Figure 10:
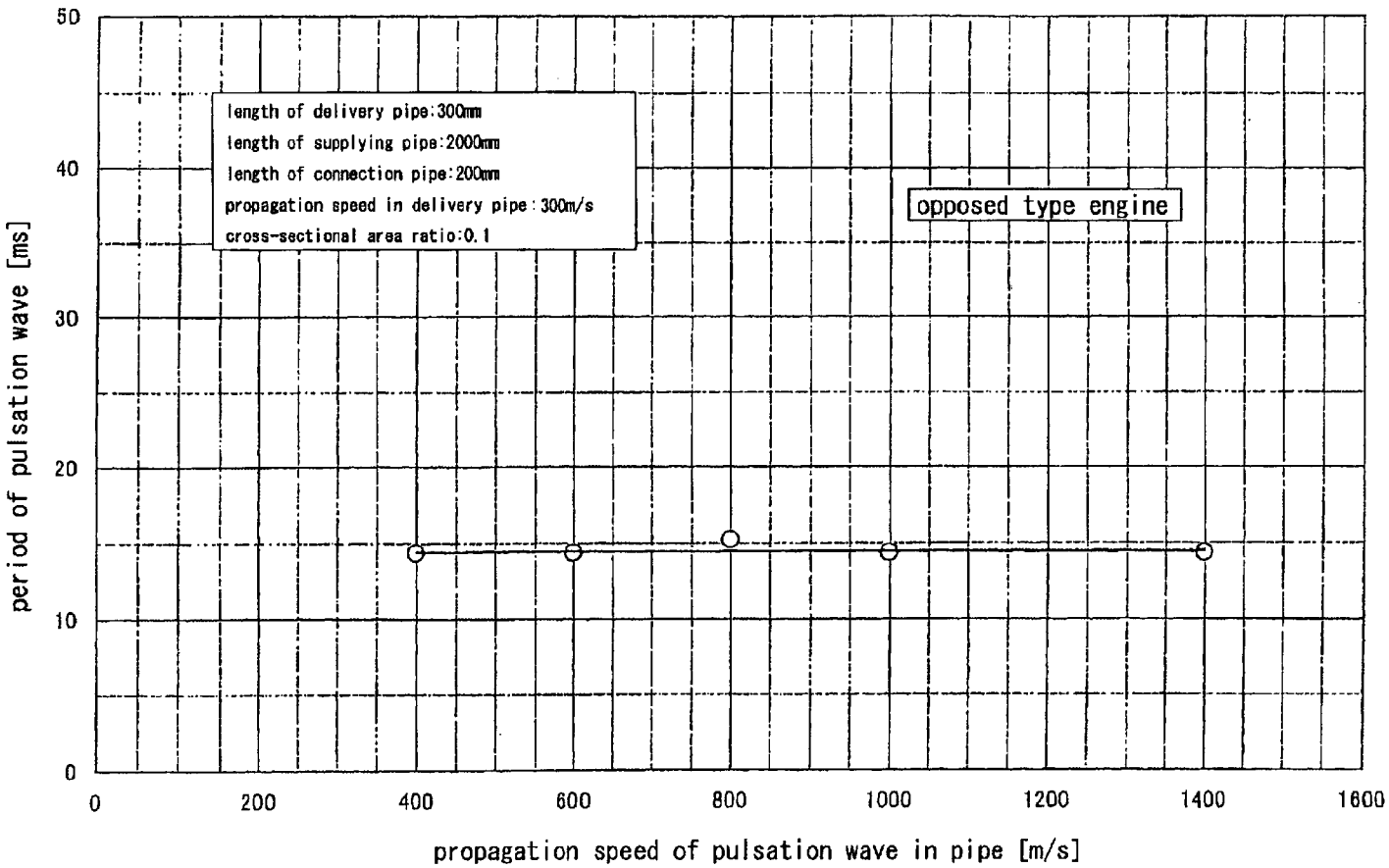
FIG. 10 is a characteristic diagram showing depending property to the propagation speed of the pipe pulsation wave of the pulsation wave between the fuel delivery pipe pair in an opposed type engine.
Figure 11:
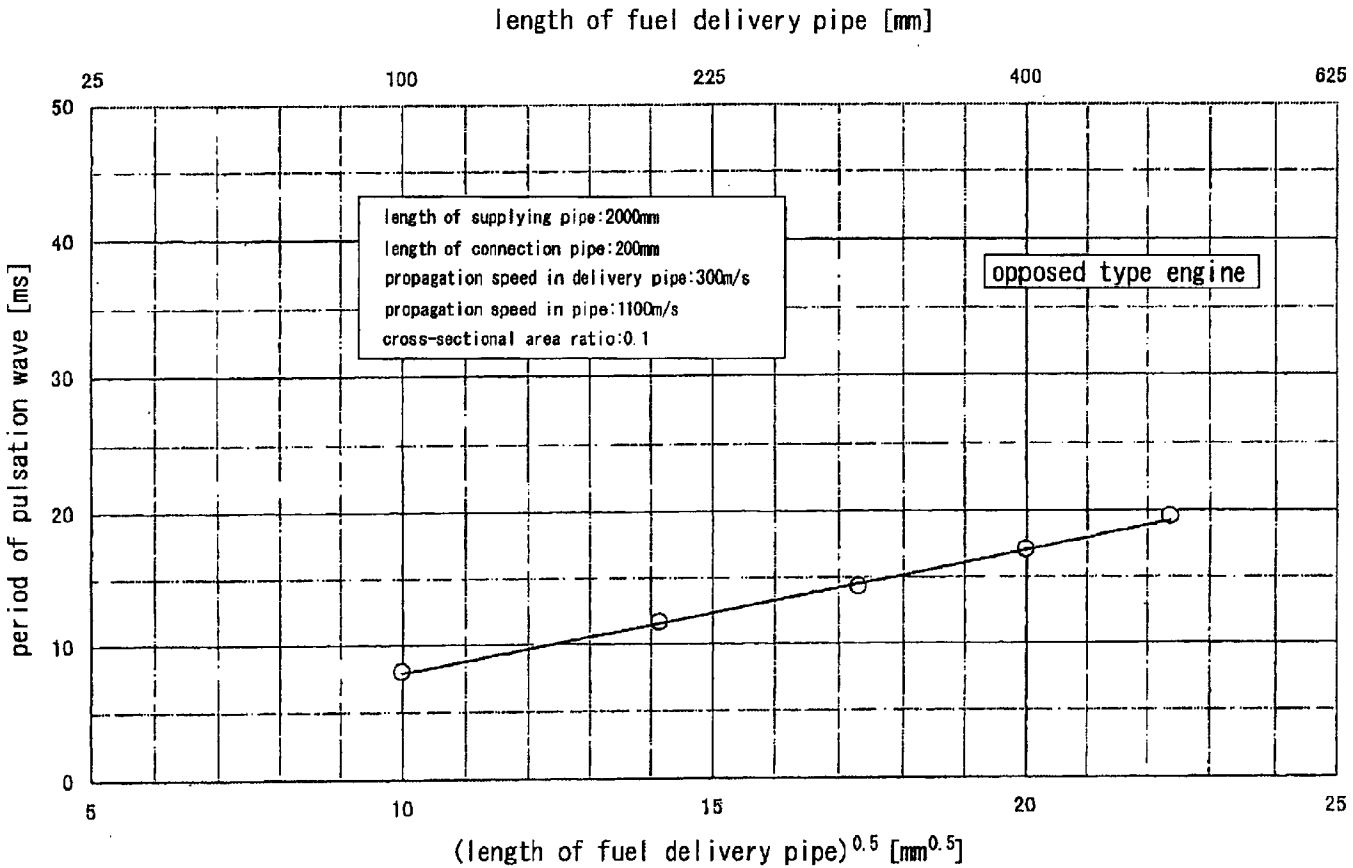
FIG. 11 is a characteristic diagram showing depending property to the fuel delivery pipe length of the pulsation wave between the fuel delivery pipe pair in an opposed type engine.
Figure 12:
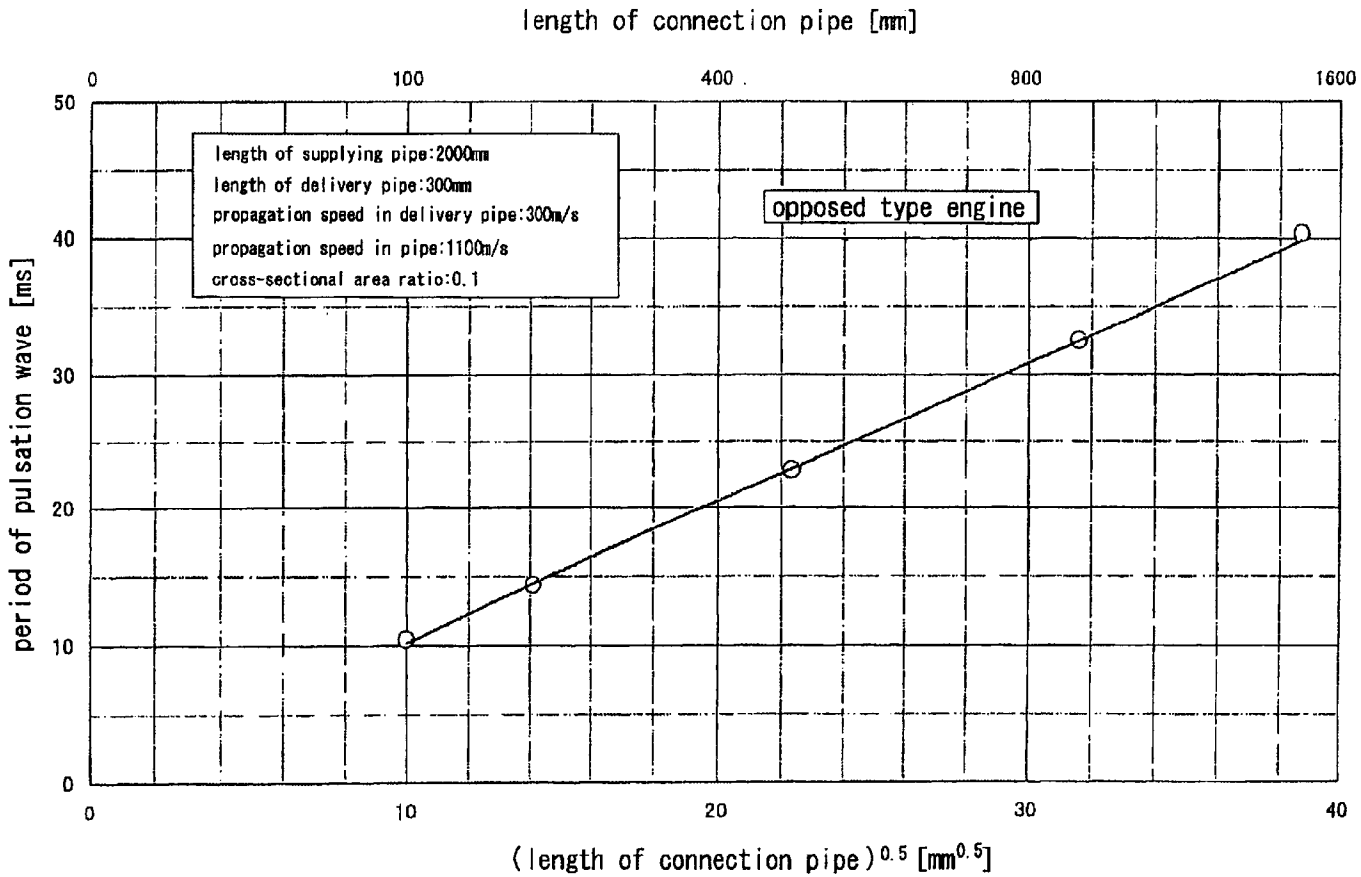
FIG. 12 is a characteristic diagram showing depending property to the connection pipe length of the pulsation wave between the fuel delivery pipe pair in an opposed type engine.
Figure 13:
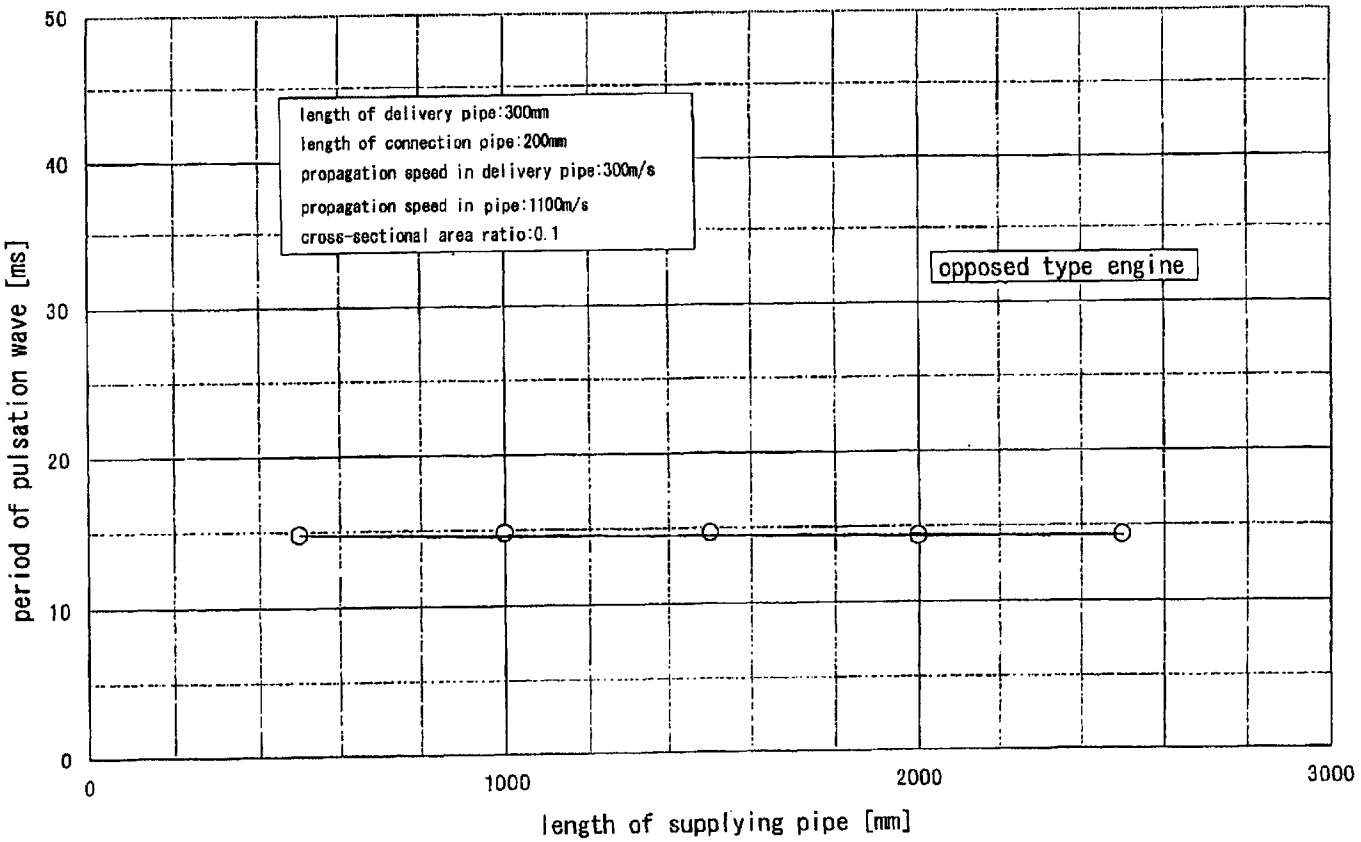
FIG. 13 is a characteristic diagram showing depending property to the supplying pipe length of the pulsation wave between the fuel delivery pipe pair in an opposed type engine.
Figure 14:
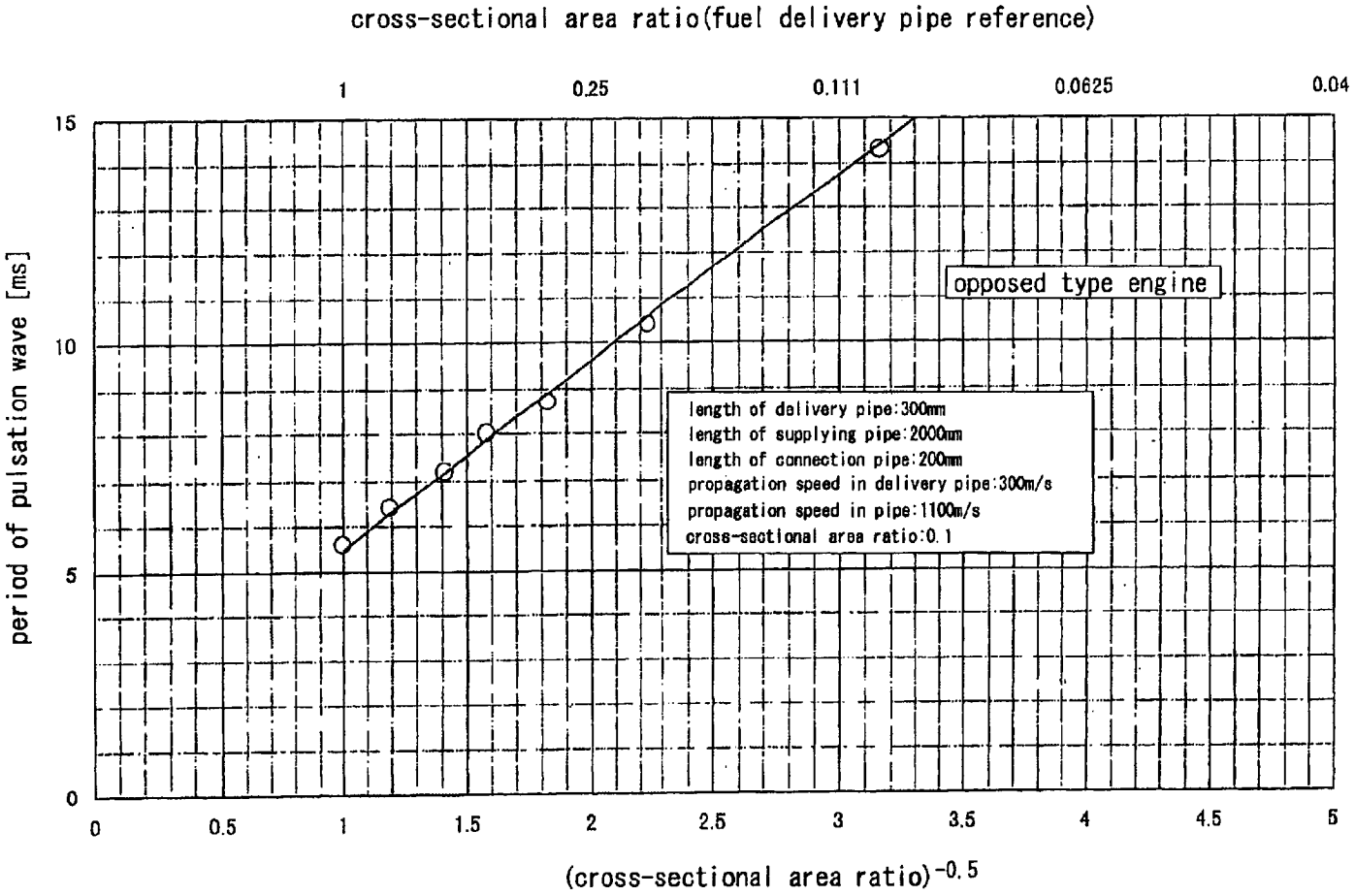
FIG. 14 is a characteristic diagram showing depending property to the fluid route cross-sectional area ratio at a boundary face between the fuel delivery pipe and the connection pipe of the pulsation wave between the fuel delivery pipe pair in an opposed type engine.

In another different embodiment, described is a system in which a choking pipe (11) as shown in FIG. 6 is added between the fuel delivery pipe (1) and the supplying pipe (5). With a structure having a propagation speed of the pulsation wave of 290 m/s and a length of 315 mm of the fuel delivery pipe (1), an outer diameter of 8 mm, a thickness of 0.7 mm, and a length of 1875 mm of a supplying pipe (5), and an inner diameter 3 mm and a length of 25 mm of the choking pipe (11), when the characteristic period of the pulsation wave is numerically analyzed, the characteristic period of the pulsation wave is 90.9 ms and the resonance point is 440 rpm in comparison with a case that no choking pipe (11) is formed.

Figure 28:
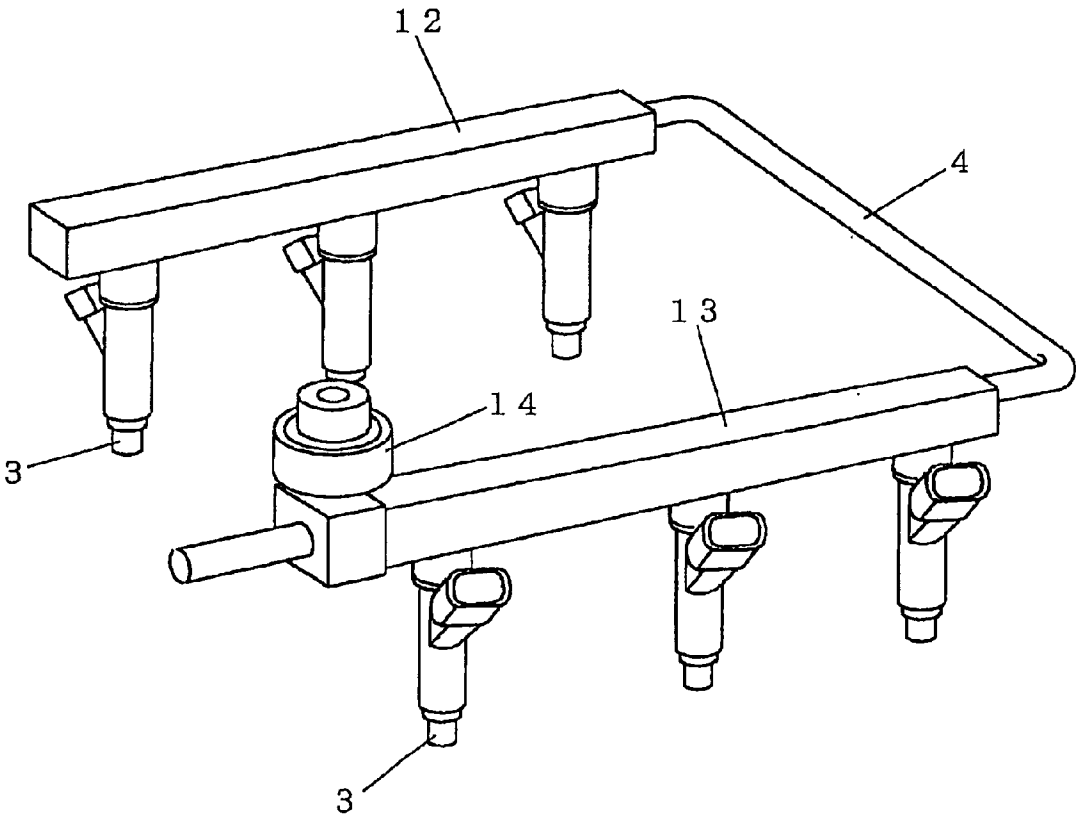
FIG. 28 is a perspective view showing an example of a rectangular fuel delivery pipe having a pulsation dumper.

Moreover, some structures have been known in which a fuel delivery pipe without capability of absorbing the pressure pulsation is formed with a structure in attaching an externally added pulsation dumper for the purpose of absorption of the pressure pulsation, in incorporating a dumper as set forth in JP-A-63-100,262, or in installing an elastic hollow body as set forth in JP-A-9-151,830. Even with the structures using such dumpers, the eigenvalue of the pressure pulsation exists in the same manner as the fuel delivery pipe (1) with capability of absorbing the pressure pulsation, and the pulsation resonance occurs. FIG. 28 shows an example in which a pulsation dumper (14) is attached to a rectangular fuel delivery pipe (13) without capability of absorbing the pressure pulsation.

In such a case, the occurrence region of the pulsation resonance point can be controlled by adjusting the cross-sectional area ratio, a length, and the like of a pipe or pipes coupling the fuel delivery pipes (1), (13). To realize this, first a pulsation resonance point of the system structured of the fuel delivery pipes having the dumper function is sought through the experiment. Then, after the propagation speed of the pulsation wave in a fuel delivery pipe having a dumper function as to coincide the above pulsation resonance point is sought through a numerical calculation, a cross-sectional area ratio and a pipe length such that the pulsation resonance point comes out of the normal use region of the engine are sought by the same steps as for the fuel delivery pipes of the pulsation resonance absorption type described above.

INDUSTRIAL APPLICABILITY

With this invention, in a fuel supplying system of non-return type for an opposed type engine, such as a V-type opposed engine or horizontal opposed engine, having a pair of fuel delivery pipes as well as an in-line type engine made of a fuel delivery pipe, as described above, the occurrence region of the pulsation resonance can be arbitrarily controlled, and therefore, various disadvantages caused by occurrences of such a pulsation resonance in a favorable rotation region for the normal use of the engine can be eliminated.

What is claimed is:

1. A method for controlling a pulsation resonance point generation region for an opposed type engine, operated with a fuel supplying system, the system comprising:

a plurality of fuel delivery pipes of a non-return type having no returning circuit to a fuel tank and having a plurality of injection nozzles, at least one of said delivery pipes having length and a flat portion extending along said length;

a plurality of banks having plural cylinders disposed in a horizontal opposed manner or a V type manner at the opposed type engine, the banks formed with the respective fuel delivery pipes;

a connection pipe connecting between a pair of said fuel delivery pipes; and a supplying pipe connecting a portion on a fuel tank side with a part of the connection pipe or with directly the other fuel delivery pipe, wherein a period of a resonance phenomenon generated between said pair of said fuel delivery pipes with respect to the pulsation wave generated during fuel injections at the injection nozzles is controlled by adjusting at least one of a rigidity of a wall face of said fuel delivery pipe, a length of the fuel delivery pipe, a fluid route cross-sectional area ratio of the fuel delivery pipe to the connection pipe, or a length of the connection pipe, to render the period of the resonance phenomenon longer to shift a pulsation resonance point out of a low rotation region of the engine.

2. A method for controlling a pulsation resonance point generation region for an opposed type engine, operated with a fuel supplying system, the system comprising:

a plurality of fuel delivery pipes of a non-return type having no returning circuit to a fuel tank and having a plurality of injection nozzles, at least one of said delivery pipes having length and a flat portion extending along said length;

a plurality of banks having plural cylinders disposed in a horizontal opposed manner or a V type manner at the opposed type engine, the banks formed with the respective fuel delivery pipes;

a connection pipe connecting between a pair of said fuel delivery pipes; and a supplying pipe connecting a portion on a fuel tank side with a part of the connection pipe or with directly the other fuel delivery pipe, wherein a period of a resonance phenomenon generated between said pair of said fuel delivery pipes with respect to the pulsation wave generated during fuel injections at the injection nozzles is controlled by adjusting at least one of a rigidity of a wall face of the fuel delivery pipe, a length of the fuel delivery pipe, a fluid route cross-sectional area ratio of the fuel delivery pipe to the connection pipe, and a length of the connection pipe, to render the period of the resonance phenomenon shorter to shift a pulsation resonance point out of a high rotation region of the engine.

3. A method for controlling a pulsation resonance point generation region for an opposed type engine, operated with a fuel supplying system, the system comprising:

a plurality of fuel delivery pipes of a non-return type having no returning circuit to a fuel tank and having a plurality of injection nozzles, at least one of said delivery pipes having length and a flat portion extending along said length;

a plurality of banks having plural cylinders disposed in a horizontal opposed manner or a V type manner at the opposed type engine, the banks formed with the respective fuel delivery pipes;

a connection pipe connecting between a pair of fuel delivery pipes via a communication choking pipe having an inner diameter smaller than that of the connection pipe; and a supplying pipe connecting a portion on a fuel tank side with a part of the connection pipe or with directly the other fuel delivery pipe, wherein a period of a resonance phenomenon generated between said pair of the fuel delivery pipes with respect to the pulsation wave generated during fuel injections at the injection nozzles is controlled by adjusting at least one of a fluid route cross-sectional area ratio of the communication choking pipe placed between the fuel delivery pipe and the connection pipe to the fuel delivery pipe, and a length of the communication choking pipe, to render the period of the resonance phenomenon longer to shift a pulsation resonance point out of a low rotation region of the engine.

4. The method for controlling a pulsation resonance point generation region for an opposed type engine according to any one of claims 1 to 3, wherein said pair of fuel delivery pipes is coupled with a pair of the connection pipes in a loop shape.

5. A method for controlling a pulsation resonance point generation region for an opposed type engine, operated with a fuel supplying system, the system comprising:

a fuel delivery pipe of a non-return type having no returning circuit to a fuel tank and having a plurality of injection nozzles, said delivery pipe having length and a flat portion extending along said length;

a plurality of banks having plural cylinders disposed in a horizontal opposed manner or a V type manner at the opposed type engine, the banks formed with the respective fuel delivery pipes;

a branching pipe coupling respectively the fuel delivery pipe with the injection nozzle; and a supplying pipe connecting a portion on a fuel tank side with the fuel delivery pipe, wherein a period of a resonance phenomenon of the pulsation wave generated during fuel injections at the injection nozzles is controlled by adjusting at least one of a rigidity of a wall face of the fuel delivery pipe, a length of the fuel delivery pipe, a fluid route cross-sectional area ratio of the fuel delivery pipe to the supplying pipe, and a length of the supplying pipe, to render the period of the resonance phenomenon longer to shift a pulsation resonance point out of a low rotation region of the engine.

6. A method for controlling a pulsation resonance point generation region for an in-line type engine, operated with a fuel supplying system, the system comprising:

an in-line type engine to which a plurality of cylinders is arranged;

a fuel delivery pipe of a non-return type having no returning circuit to a fuel tank and having a plurality of injection nozzles disposed at the in-line type engine, said delivery pipe having length and a flat portion extending along said length; and a supplying pipe connecting a portion on a fuel tank side with the fuel delivery pipe, wherein a period of a resonance phenomenon generated between the fuel delivery pipe and the fuel tank with respect to the pulsation wave generated during fuel injections at the injection nozzles is controlled by adjusting at least one of a rigidity of a wall face of the fuel delivery pipe, a length of the fuel delivery pipe, a fluid route cross-sectional area ratio of the fuel delivery pipe to the supplying pipe, and a length of the supplying pipe, to render the period of the resonance phenomenon longer to shift a pulsation resonance point out of a low rotation region of the engine.

7. A method for controlling a pulsation resonance point generation region for an in-line type engine, operated with a fuel supplying system, the system comprising:

an in-line type engine to which a plurality of cylinders is arranged;

a fuel delivery pipe of a non-return type having no returning circuit to a fuel tank and having a plurality of injection nozzles disposed at the in-line type engine, said delivery pipe having length and a flat portion extending along said length; and a supplying pipe connecting a portion on a fuel tank side with the fuel delivery pipe, wherein a period of a resonance phenomenon generated between the fuel delivery pipe and the fuel tank with respect to the pulsation wave generated during fuel injections at the injection nozzles is controlled by adjusting at least one of a rigidity of a wall face of the fuel delivery pipe, a length of the fuel delivery pipe, a fluid route cross-sectional area ratio of the fuel delivery pipe to the supplying pipe, and a length of the supplying pipe, to render the period of the resonance phenomenon shorter to shift a pulsation resonance point out of a high rotation region of the engine.

8. A method for controlling a pulsation resonance point generation region for an in-line type engine, operated with a fuel supplying system, the system comprising:

an in-line type engine to which a plurality of cylinders is arranged;

a fuel delivery pipe of a non-return type having no returning circuit to a fuel tank and having a plurality of injection nozzles disposed at the in-line type engine, said delivery pipe having length and a flat portion extending along said length; and a supplying pipe connecting a portion on a fuel tank side with the fuel delivery pipe, wherein a period of a resonance phenomenon generated between the fuel delivery pipe and the fuel tank with respect to the pulsation wave generated during fuel injections at the injection nozzles is controlled by adjusting at least one of a fluid route cross-sectional area ratio of a communication choking pipe placed between the fuel delivery pipe and the supplying pipe to the fuel delivery pipe, and a length of the communication choking pipe, to render the period of the resonance phenomenon longer to shift a pulsation resonance point out of a low rotation region of the engine.

9. The method for controlling a pulsation resonance point generation region for an opposed type engine according to any of claims 1 to 3, wherein the fuel delivery pipe has a pulsation wave absorbing function for absorbing a pulsation wave generated during fuel injections at the injection nozzles.

10. The method for controlling a pulsation resonance point generation region for an in-line type engine according to any of claims 6 to 8, wherein the fuel delivery pipe has a pulsation wave absorbing function for absorbing a pulsation wave generated during fuel injections at the injection nozzles.

11. The method for controlling a pulsation resonance point generation region for an opposed type engine according to any one of claims 1 to 3 or 5, wherein the fuel delivery pipe does not has a pulsation wave absorbing function for absorbing a pulsation wave generated during fuel injections at the injection nozzles.

12. The method for controlling a pulsation resonance point generation region for an in-line type engine according to any one of claims 6 to 8, wherein the fuel delivery pipe does not has a pulsation wave absorbing function for absorbing a pulsation wave generated during fuel injections at the injection nozzles.

* * * * *